US005448899A

United States Patent [19]

Ohara et al.

[11] Patent Number: 5,448,899

[45] Date of Patent: Sep. 12, 1995

[54] REFRIGERANT EVAPORATOR

[75] Inventors: Toshio Ohara, Kariya; Yoshiyuki Yamauchi; Masahiro Shimoya, both of Chita; Etuo Hasegawa, Kounan; Keiichi Yoshii, Kariya; Keiichi Kitamura, Handa; Kenichi Fujiwara, Kariya; Yasushi Yamanaka, Aichi; Hisayoshi Sakakibara, Nishio; Yosiharu Kajikawa, Hekinan, all of Japan

[73] Assignee: Nippondenso Co., Ltd., Kariya, Japan

[21] Appl. No.: 138,227

[22] Filed: Oct. 20, 1993

[30] Foreign Application Priority Data

Oct. 21, 1992 [JP] Japan ..... 4-282688
Aug. 10, 1993 [JP] Japan ..... 5-198198
Sep. 21, 1993 [JP] Japan ..... 5-235229

[51] Int. Cl.[6] ..... F25B 39/02

[52] U.S. Cl. ..... 62/525; 62/527; 165/153; 165/174

[58] Field of Search ..... 62/503, 509, 512, 524, 62/525, 526, 523, 527, 528; 165/153, 152, 158, 174, 175, 176

[56] References Cited

U.S. PATENT DOCUMENTS 4,341,086 7/1982 Ishii ..... 62/512 X
4,370,868 2/1983 Kim et al. ..... 62/527 X
4,821,531 4/1989 Yamauchi et al. ..... 62/515
5,062,477 11/1991 Kadle ..... 62/525 X
5,111,878 5/1992 Kadle ..... 165/174 X
5,172,759 12/1992 Shimoya et al. ..... 165/153 X

FOREIGN PATENT DOCUMENTS 61-62756 3/1986 Japan .
2-63146 12/1990 Japan .
5-18635 1/1993 Japan .
5018635 1/1993 Japan .
5-79725 3/1993 Japan .
5079725 3/1993 Japan .

*Primary Examiner*—Harry B. Tanner
*Attorney, Agent, or Firm*—Cushman, Darby & Cushman

[57] ABSTRACT

A refrigerant evaporator for a refrigeration cycle which separates a refrigerant of a two-phase gas and liquid state introduced from a pressure reduction means into a liquid refrigerant and a gas refrigerant by a gas and liquid separation means and distributes at least the liquid refrigerant to a plurality of refrigerant passageways of a heat exchange portion by a distribution means such as a tank. The distributed refrigerant has a single phase such as a liquid refrigerant and therefore the distribution is uniformly and equally carried out, the efficiency of the evaporator becomes higher, and the size can be reduced.

8 Claims, 35 Drawing Sheets

REFRIGERANT EVAPORATOR

BACKGROUND OF THE INVENTION

1. Field of the Invention

The present invention relates to a refrigerant evaporator used in a refrigeration cycle such as of a car air-conditioner or room air-conditioner.

2. Description of the Related Art

In a refrigerant evaporator of a refrigeration cycle, the amount of the refrigerant distributed to each of a plurality of tubes constituting parallel refrigerant passageways is desirably homogeneous so as to improve the efficiency thereof.

Therefore, Japanese Examined Patent Publication (Kokoku) No. 2-63146 discloses a technique in which a liquid refrigerant condensed in a refrigerant condenser is further supercooled and then reduced in pressure by an expansion valve, then the degree of dryness of the refrigerant flowing into a flow divider is reduced to be as small as possible so as to make the amount of distribution of refrigerant from the flow divider to the respective refrigerant passageways of the refrigerant evaporator uniform.

Also, Japanese Unexamined Patent Publication (Kokai) No. 61-62756 discloses a technique in which after the supercooled liquid refrigerant is reduced in pressure, a refrigerant which is still in a liquid single-phase state is introduced to the flow divider so as to make the amount of distribution of refrigerant to the respective refrigerant passageways uniform.

According to the above-mentioned related art, however, there were problems in that a supercooler for further supercooling the refrigerant condensed by the refrigerant condenser became necessary, and major modification of the refrigeration cycle became required since a two-stage pressure reduction system was adopted, etc, whereby the system became complex and the costs rose.

SUMMARY OF THE INVENTION

The present invention was made so as to solve these problems of the related art as mentioned above and has as its object, first, to provide a means with which the amount of refrigerant distributed to each of a plurality of refrigerant passageways in a refrigerant evaporator can be made uniform.

Another object of the present invention is to provide a means with which the amount of refrigerant distributed to each of a plurality of refrigerant passageways in the refrigerant evaporator is made uniform so as to enable heat exchange to be carried out in the entire area of the refrigerant evaporator with a high efficiency and improve the performance of the refrigerant evaporator and, at the same time, with which the refrigerant evaporator can be reduced in size.

Still another object of the present invention is to provide a refrigerant evaporator which does not require major modification of the refrigeration cycle etc. since the refrigerant is uniformly distributed to each of a plurality of refrigerant passageways of the refrigerant evaporator, which has a simple construction, and which is inexpensive in its cost.

So as to achieve the above-described objects, the present invention provides a refrigerant evaporator characterized in that it is provided with a plurality of refrigerant passageways arranged in parallel; at least one fin which is interposed among the aforesaid plurality of refrigerant passageways and forms a heat exchange portion together with the aforesaid refrigerant passageways; a gas and liquid separation means which separates the refrigerant of the two gas and liquid phases introduced from a pressure reduction means into a liquid refrigerant and a gas refrigerant; and a liquid refrigerant distribution means which distributes, out of the liquid refrigerant and gas refrigerant separated by the aforesaid gas and liquid separation means, at least the liquid refrigerant to the aforesaid refrigerant passageways.

Since the present invention is constituted as described above, a refrigerant pressurized in the refrigeration cycle such as of an air-conditioning apparatus passes through a pressure reduction means to be reduced in pressure so that it becomes a refrigerant of two gas and liquid phases and then flows into the gas and liquid separation means where it is separated to the liquid refrigerant and the gas refrigerant. Among the separated liquid refrigerant and gas refrigerant, at least the liquid refrigerant is distributed to a plurality of refrigerant passageways by the liquid refrigerant distribution means. Heat exchange between the same and the outside air is carried out in the refrigerant passageways and the liquid refrigerant is evaporated to become the gas refrigerant. At this time, it robs heat from the outside air with the assistance of the fins.

According to the present invention, the refrigerant distributed to a plurality of refrigerant passageways has been preliminarily separated to a liquid refrigerant and a gas refrigerant by the gas and liquid separation means and, out of the separated liquid refrigerant and gas refrigerant, at least the liquid refrigerant is distributed solely to a plurality of refrigerant passageways by the liquid refrigerant distribution means. In a certain case, the separated gas refrigerant is also solely distributed to a plurality of refrigerant passageways by a gas refrigerant distribution means, but in any case, the distribution of the refrigerant to a plurality of refrigerant passageways by the distribution means is a distribution of a fluid of a single phase composed of only the liquid refrigerant or gas refrigerant. Therefore, unlike the distribution of a mixed two-phase gas and liquid fluid, the distribution of the refrigerant to a plurality of refrigerant passageways is homogeneously carried out. By this, the whole area of the evaporation portion of the refrigerant evaporator acts with a high efficiency, and therefore it becomes possible to reduce the size of the refrigerant evaporator from that of the conventional evaporator with respect to a thermal load having the same magnitude. In addition, the structure of the present invention is simple with no great increase in costs.

Other objects and advantages of the present invention will be more apparent to persons skilled in the art from the following detailed explanation of the preferred embodiments given in reference to the accompanying drawings.

DESCRIPTION OF THE PREFERRED EMBODIMENTS

An explanation will be made next of a first embodiment of a refrigerant evaporator of the present invention based on FIG. 1 through FIG. 11.

Figure 1:
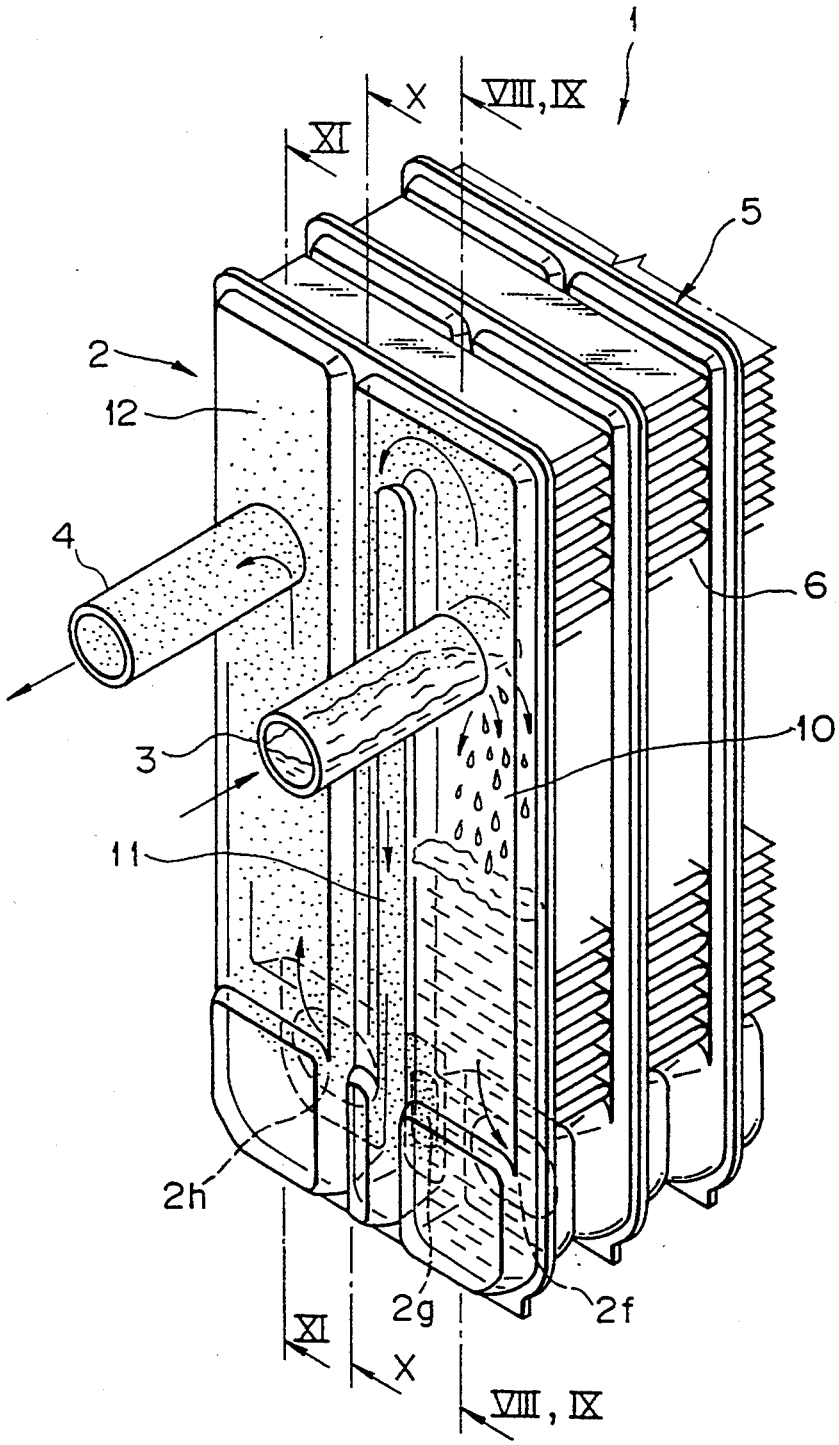
FIG. 1 is a perspective view of a gas and liquid separation chamber according to a first embodiment.

FIG. 1 is perspective view mainly showing the construction of a gas and liquid separation chamber.

The refrigerant evaporator 1 of the present embodiment is constituted by a core portion (mentioned below) performing the heat exchange between the refrigerant and the air; a gas and liquid separation chamber 2 (gas and liquid separation means) which separates the two-phase gas and liquid refrigerant supplied from a pressure reduction means such as an expansion valve (not illustrated) to a gas part and a liquid part; an inlet pipe 3 introducing the refrigerant reduced in pressure by the pressure reduction means to the gas and liquid separation chamber 2; and an outlet pipe 4 guiding the gas refrigerant evaporated at the core portion out of the gas and liquid separation chamber 2. It is fabricated by joining these parts integrally by brazing.

The core portion (heat exchange portion) is constituted by alternately laminating a large number of flat tubes 5 (refrigerant passageways) and corrugated fins 6.

Figure 2:
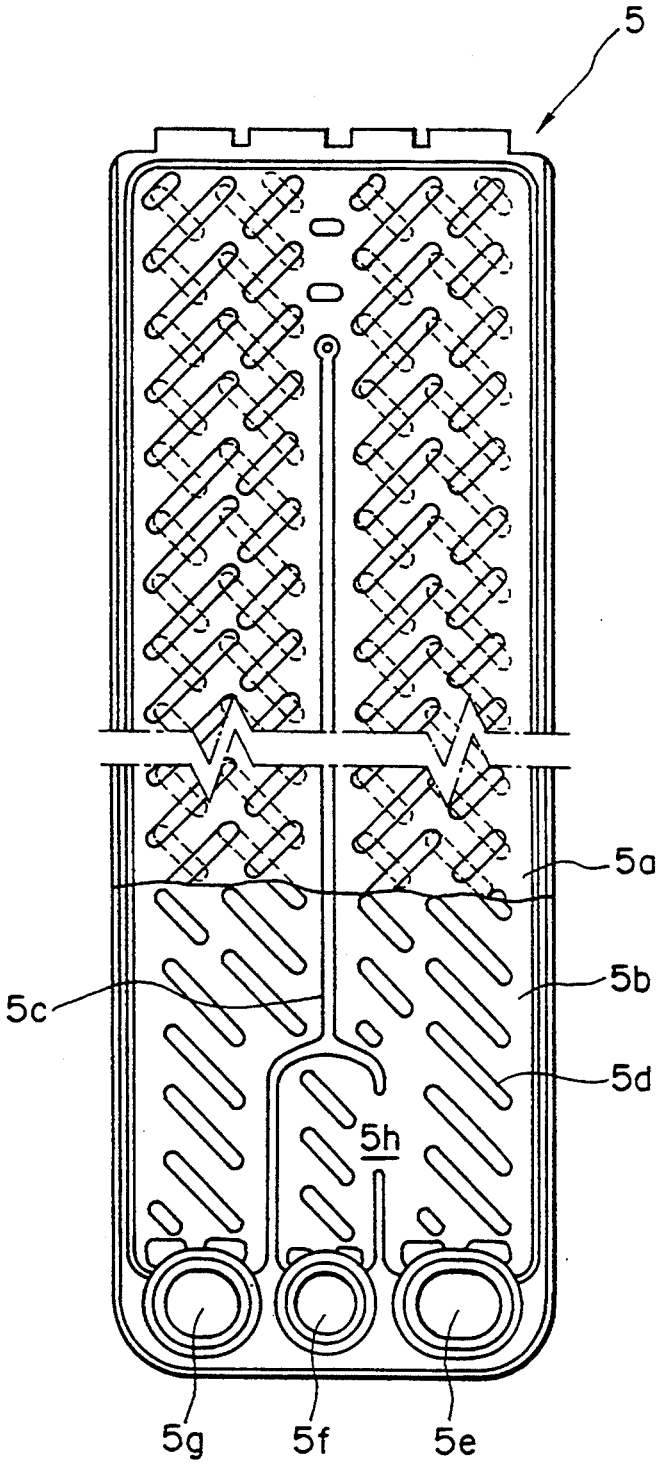
FIG. 2 is a front view including a partial cross-section of a flat tube.

Each flat tube 5 is formed by two plates 5*a* and 5*b* facing each other (refer to FIG. 2). For these plates 5*a* and 5*b*, brazing sheets obtained by cladding an aluminum brazing material on the two surfaces of a core material (for example A3003) are used.

Figure 3:
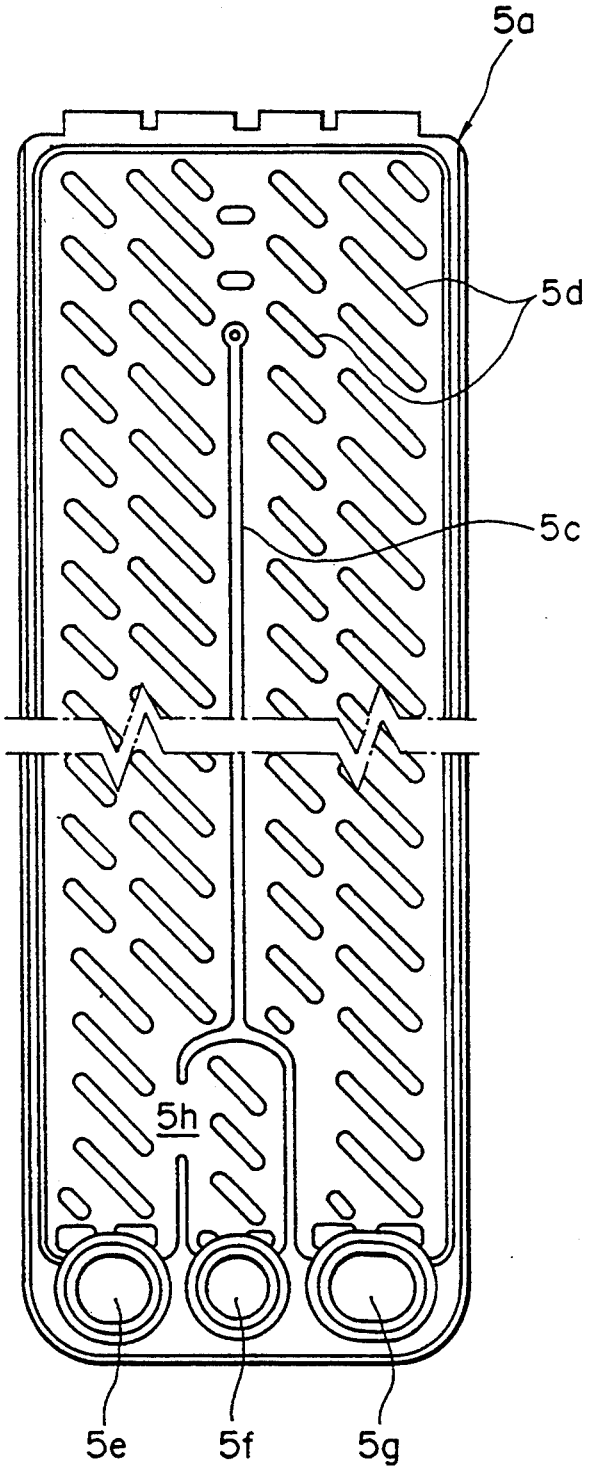
FIG. 3 is a back view of a plate constituting a flat tube.
Figure 4:
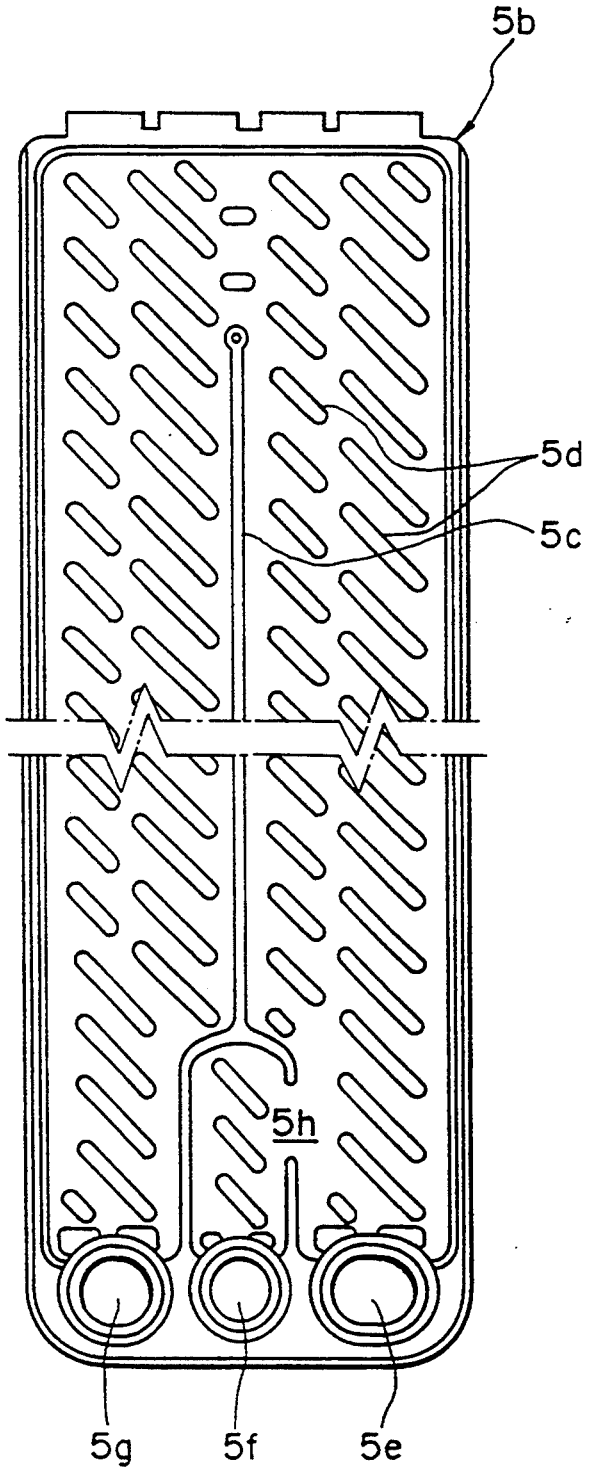
FIG. 4 is a plan view of the plate constituting the flat tube.

In the plates 5*a* and 5*b*, as shown in FIG. 3 and FIG. 4, a partition rib 5*c* extending in the vertical direction is provided at the center portion. At the same time, a large number of oblique ribs 5*d* are provided on the surface. Also, the lower end side of the partition rib 5*c* is branched into two. One of the branched portions is partially omitted midway of the partition rib 5c. At the lowermost portion of the plates 5a and 5b, three openings (a liquid tank opening 5e, a gas tank opening 5f, and an outlet tank opening 5g) are formed in alignment.

The flat tube 5 is constituted by placing these plates 5a and 5b to face each other so that the mutual partition ribs 5c abut against each other and an inverse U-shaped refrigerant passageway is formed inside the flat tube 5. Also, the oblique ribs 5d of the plates 5a and 5b abut each other so as to intersect each other and disturb the flow of the refrigerant flowing through the refrigerant passageway. The liquid tank opening 5e and the outlet tank opening 5g are communicated to the two end portions of the refrigerant passageway, and the gas tank opening 5f is communicated with the refrigerant passageway via a communication port 5h formed by the omitted part of the partition rib 5c.

Figure 10:
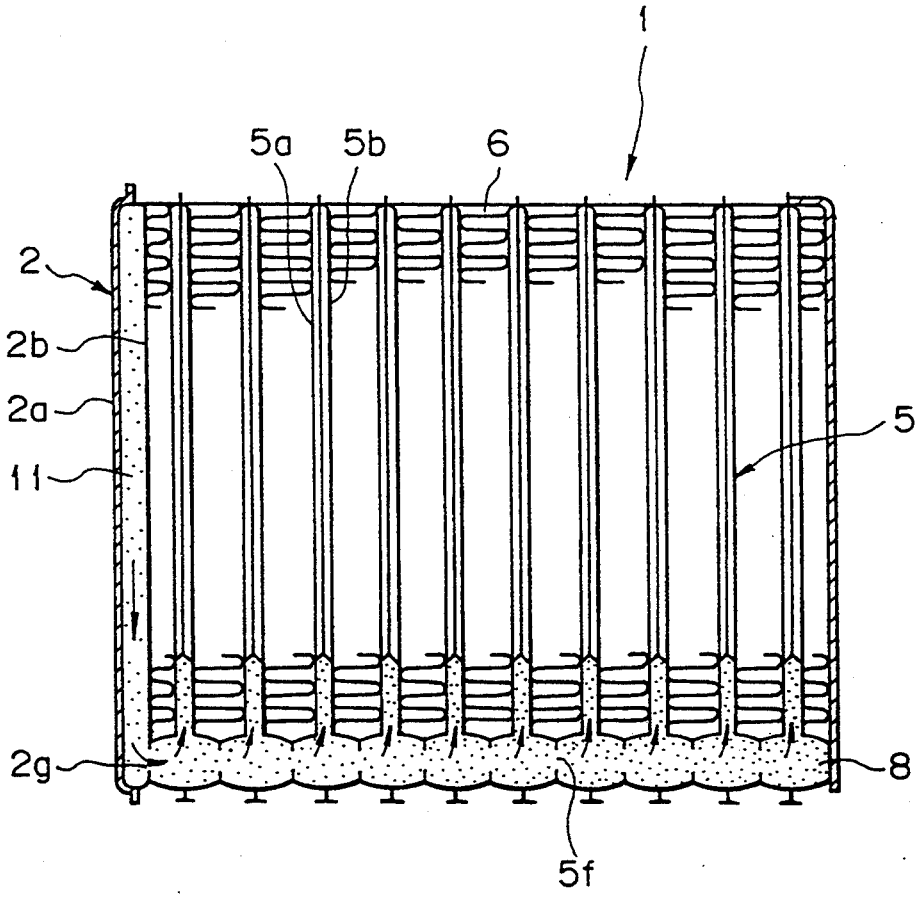
FIG. 10 is a cross-sectional view of the entire refrigerant evaporator shown in FIG. 1 taken along a line X—X.
Figure 11:
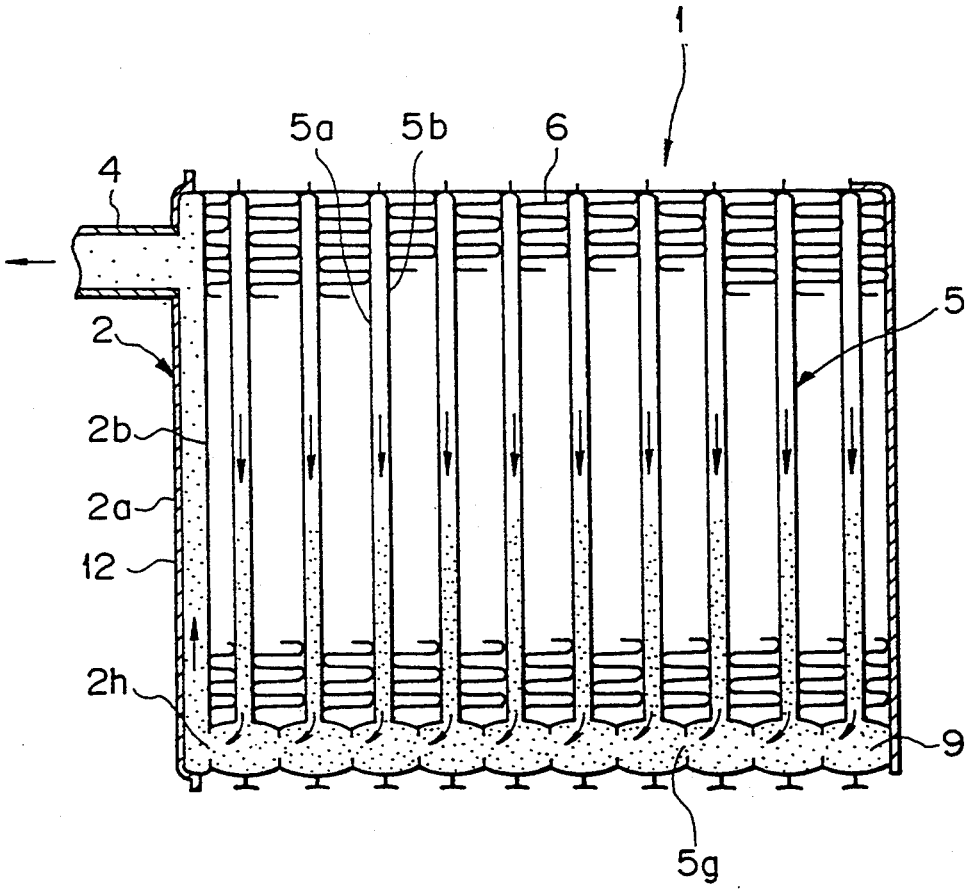
FIG. 11 is a cross-sectional view of the entire refrigerant evaporator shown in FIG. 1 taken along a line XI—XI.

A large number of these flat tubes 5 are stacked together with the corrugated fins to form the core portion, whereby the liquid tank openings 5e, the gas tank openings 5f, and the outlet tank openings 5g of the flat tubes 5 are communicated to constitute a liquid tank 7 (refer to FIG. 9; a cross-sectional view of a refrigerant evaporator 1 taken along a line A—A of FIG. 1); a gas tank 8 (refer to FIG. 10; a cross-sectional view of the refrigerant evaporator 1 taken along a line B—B of FIG. 1), and an outlet tank 9 (refer to FIG. 11; a cross-sectional view of the refrigerant evaporator 1 taken along a line C—C of FIG. 1).

The corrugated fin 6 is a rolled product obtained by shaping a thin aluminum sheet into a corrugated form. A large number of louvers (not illustrated) are formed at the surface so as to enhance the heat exchange efficiency.

The gas and liquid separation chamber 2 comprises two plates 2a and 2b formed by brazing sheets similar to those of the flat tube 5 and is provided at one end portion in the stacking direction of the core portion.

Figure 5:
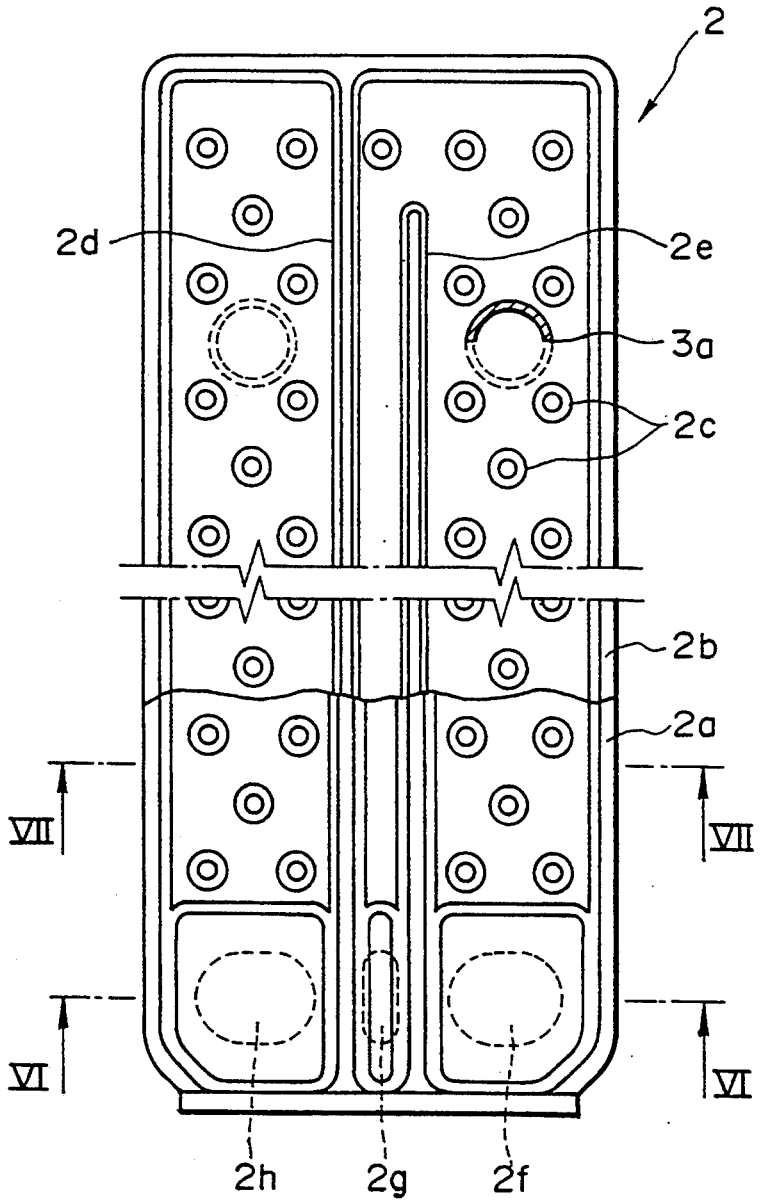
FIG. 5 is a front view including a cross-section of the gas and liquid separation chamber shown in FIG. 8 taken along a line V—V.
Figure 8:
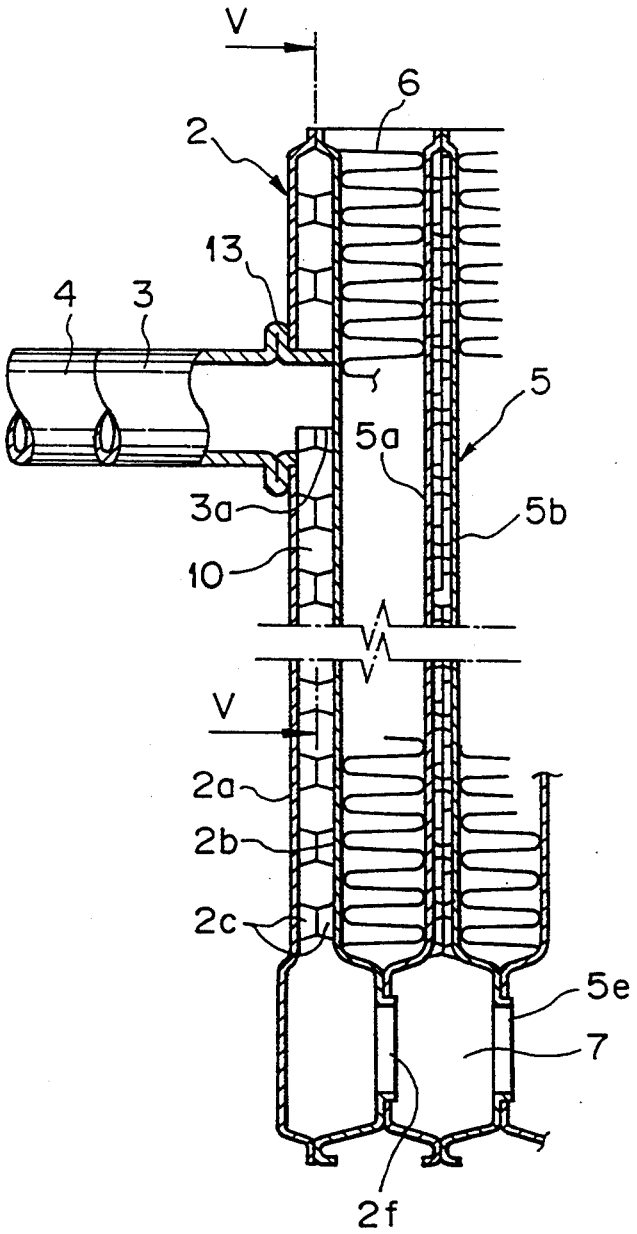
FIG. 8 is a side cross-sectional view of the gas and liquid separation chamber shown in FIG. 1 taken along a line VIII—VIII.

In the plates 2a and 2b, as shown in FIG. 5 (front view of the gas and liquid separation chamber 2 including an F—F cross section of FIG. 8), a large number of dimples 2c are formed at the surface thereof by press forming. At the same time, two ribs 2d and 2e extending in the vertical direction at an equal interval are provided. One rib 2d is extended from the lower end to the upper end of the plates 2a and 2b. The other rib 2e is provided so as to be extended from the lower end to the upper portion of the plates 2a and 2b without reaching the upper end.

Also, at the lowermost portion of the plate 2b arranged on the core portion side, three openings (a liquid side opening 2f, a gas side opening 2g, and an outlet side opening 2h) are formed in the flat portion defined by two ribs 2d and 2e.

Note that, the dimples 2c function to enhance the pressure resistance by joining the plate 2a and plate 2b at many points and, at the same time, function to promote the gas and liquid separation by the collision of the two-phase gas and liquid flows.

Figure 6:
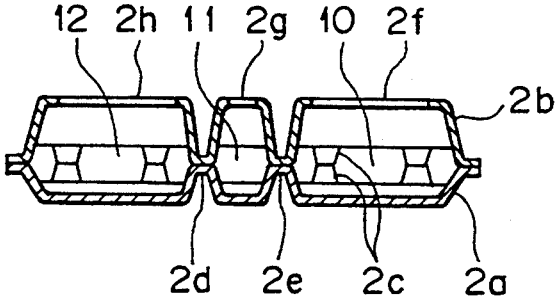
FIG. 6 is a cross-sectional view of the gas and liquid separation chamber shown in FIG. 5 taken along a line VI—VI.
Figure 7:
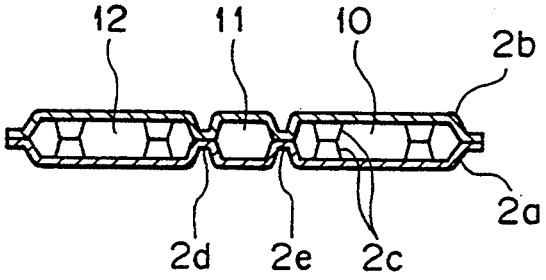
FIG. 7 is a cross-sectional view of the gas and liquid separation chamber shown in FIG. 5 taken along a line VII—VII.

The two plates 2a and 2b are brazed as shown in FIG. 6 (a D—D cross-sectional view of FIG. 5) and FIG. 7 (an E—E cross-sectional view of FIG. 5), in a state with the dimples 2c and ribs 2d and 2e facing each other, to form a flat gas and liquid separation chamber 2. Then, in this gas and liquid separation chamber 2, a vertically long liquid accumulation chamber 10, gas accumulation chamber 11, and outlet chamber 12 which are partitioned by the two ribs 2d and 2e are formed. Of these liquid accumulation chamber 10, gas accumulation chamber 11, and outlet chamber 12, the liquid accumulation chamber 10 and the gas accumulation chamber 11 are formed on the two sides sandwiching between them the gas accumulation chamber 11. The gas accumulation chamber 11 is formed narrower than the liquid accumulation chamber 10 and the outlet chamber 12. Also, the outlet chamber 12 and the gas accumulation chamber 11 are completely sectioned off by the rib 2d, while the liquid accumulation chamber 10 and the gas accumulation chamber 11 are communicated at the upper portion side of the rib 2e. In this gas and liquid separation chamber 2, the liquid accumulation chamber 10, the gas accumulation chamber 11, and the outlet chamber 12 are communicated via the liquid side opening 2f, the gas side opening 2g, and the outlet side opening 2h, to the liquid tank 7, gas tank 8, and the outlet tank 9 of the core portion, respectively (refer to FIG. 9, FIG. 10, and FIG. 11).

The inlet pipe 3 and the outlet pipe 4 are inserted into insertion holes (not illustrated) provided at the upper portion of the plate 2e so as to be communicated with the liquid accumulation chamber 10 and the outlet chamber 12 of the gas and liquid separation chamber 2, respectively, and are joined to the plate 2a by brazing, at barring portions 13 formed at the front end portions of the pipes 3 and 4 (refer to FIG. 8, side cross-sectional view of the gas and liquid separation chamber 2).

The front end side of the inlet pipe 3 projects from the barring portion 13 and is inserted into the liquid accumulation chamber 10 until the front end surface abuts against the plate 2b on the core portion side. At the projected front end portion, as shown in FIG. 5 and FIG. 8, a recess portion 3a opened downward is formed.

The outlet pipe 4 is meant to allow the gas refrigerant evaporated at the core portion to flow out of the outlet chamber 12. It is not inserted into the interior of the outlet chamber 12, but is provided so that the front end surface thereof becomes the same plane as the inner wall surface of the plate 2a on the outside.

An explanation will be made next of the operation of the present embodiment.

The two-phase gas and liquid refrigerant reduced in pressure by the pressure reduction means flows into the liquid accumulation chamber 10 of the gas and liquid separation chamber 2 through the inlet pipe 3.

Here, since the front end portion of the inlet pipe 3 is opened downward by the recess portion 3a, the two-phase gas and liquid refrigerant strikes the inner wall surface of the liquid accumulation chamber 10, and then flows downward into the liquid accumulation chamber 10 from the recess portion 3a. At this time, by the function of the downward inertia force and gravity, the liquid refrigerant and gas refrigerant are separated, the liquid refrigerant is accumulated close to the lower portion inside the liquid accumulation chamber 10 and, at the same time, the gas refrigerant rises in the liquid accumulation chamber 10 and flows into the adjoining gas accumulation chamber 11.

Figure 9:
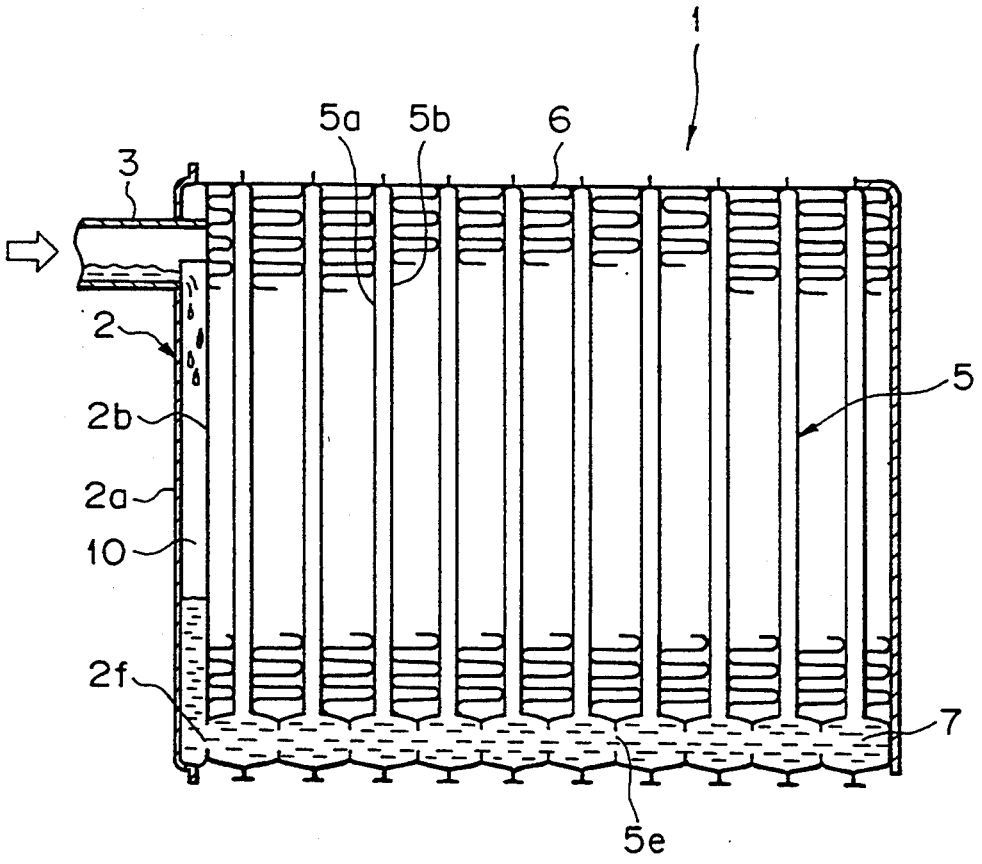
FIG. 9 is a cross-sectional view of an entire refrigerant evaporator shown in FIG. 1 taken along a line IX—IX.

The liquid refrigerant accumulated close to the lower portion of the liquid accumulation chamber 10 flows into the liquid tank 7 via the liquid side opening 2f as shown in FIG. 9, is filled in the liquid tank 7, and then is uniformly and equally distributed to the refrigerant passageways of the flat tubes 5. Also, the gas refrigerant flowing into the gas accumulation chamber 11 flows into the gas tank 8 via the gas side opening 2g as shown in FIG. 10, is uniformly and equally distributed to the flat tubes 5 from the gas tank 8, and then flows into the refrigerant passageways via the communication port 5h of the flat tubes 5 shown in FIG. 2 to FIG. 4, and is combined with the liquid refrigerant.

The refrigerant flowing through the refrigerant passageways of the flat tubes 5 undergoes heat exchange with the air on the periphery and is evaporated to become the gas refrigerant, which gathers at the outlet tank 9 and then, as shown in FIG. 11, flows into the outlet chamber 12 of the gas and liquid separation chamber 2 via the outlet side opening 2h from the outlet tank 9 and flows out of the outlet pipe 4.

In this way, in the present embodiment, the two-phase gas and liquid refrigerant supplied from the pressure reduction means to the refrigerant evaporator 1 is subjected to the gas and liquid separation at the gas and liquid separation chamber 2, whereby the liquid refrigerant can be uniformly and equally distributed to the flat tubes 5. Accordingly, the refrigerant does not become excessive or in short supply among the flat tubes 5, and therefore the refrigerant evaporator 1 can be effectively used to the highest extent. By this, it becomes possible to reduce the size of the refrigerant evaporator 1.

Also, where the gas refrigerant separated at the gas and liquid separation chamber 2 is not introduced to the core portion, but is discharged as it is, even if a mist (mist-like liquid refrigerant) is contained in the gas refrigerant after the separation, the mist does not contribute to the heat exchange, but is discharged uselessly. Contrary to this, the present embodiment is constituted so that the gas refrigerant separated at the gas and liquid separation chamber 2 is not discharged as it is, but passes through communication ports 5h and is combined in the refrigerant passageways, and therefore all the liquid refrigerant can be effectively utilized for the evaporation.

Also, it is possible to achieve these effects without major modification of the structure of the refrigeration cycle, but by merely adding the gas and liquid separation chamber 2 formed by the two plates 2a and 2b to the core portion.

In the present embodiment, dimples 2c were provided on the surface of the plates 2a and 2b, but it is also possible to provide a large number of oblique ribs on the surface of the plates 2a and 2b in the same way as the plates 5a and 5b constituting the flat tube 5 and join them at the mutually intersecting points of the oblique ribs. Moreover, the construction is not restricted to the dimples 2c or oblique ribs. Any construction can be adopted so far as the plate 2a and the plate 2b are locally joined to exhibit a function of keeping the pressure resistance and promoting the gas and liquid separation.

In the present embodiment, the gas and liquid separation chamber 2 was formed integrally with the core portion, but it is also possible to provide the same as a separate body.

A second embodiment of the present invention will be explained next.

Figure 12:
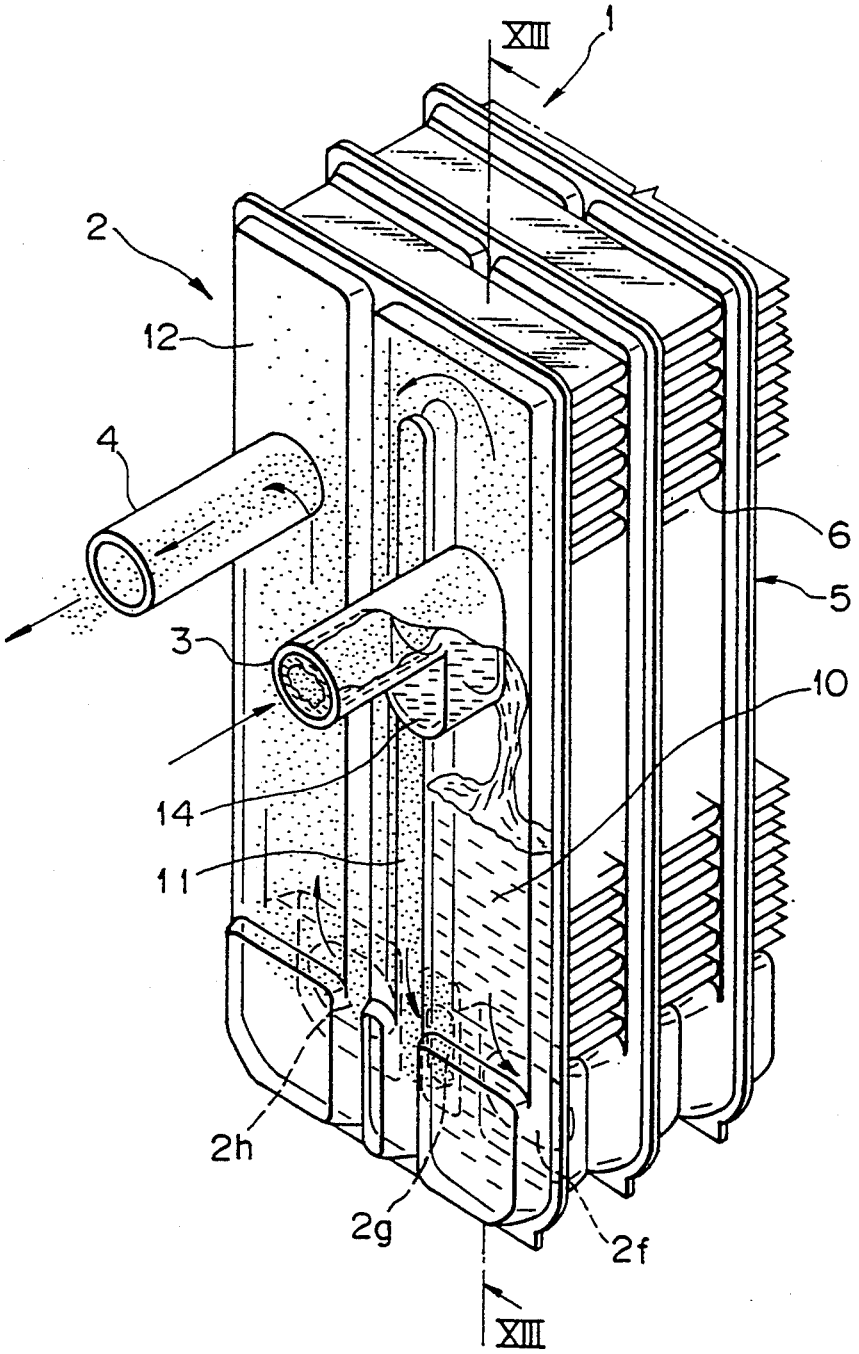
FIG. 12 is a perspective view of the gas and liquid separation chamber according to a second embodiment.

FIG. 12 is a perspective view of a gas and liquid separation means according to the present embodiment.

The gas and liquid separation means of the present embodiment is constituted by a gas and liquid separation chamber 2 explained in the first embodiment (the explanation will be omitted since it is overlapping) and an enlarged portion 14 provided at the inlet pipe 3. This enlarged portion 14 is formed by enlarging the cross-sectional surface area of the passageway of the inlet pipe 3 down from the inlet pipe 3 at the end portion on the downstream side of the inlet pipe 3 opened at the liquid accumulation chamber 10.

Figure 13:
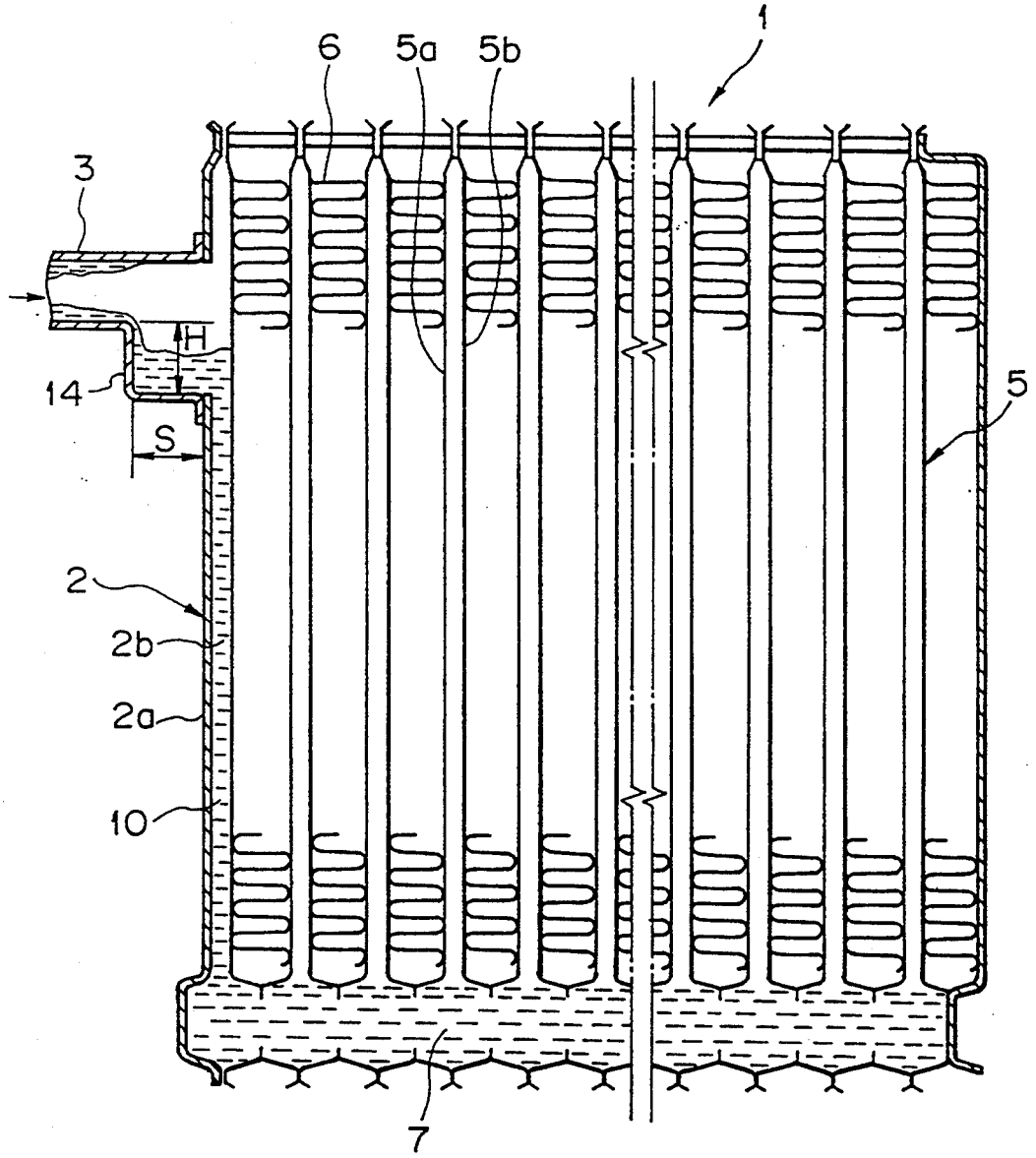
FIG. 13 is a cross-sectional view of a refrigerant evaporator including a liquid accumulation chamber of the second embodiment shown in FIG. 12 taken along a line XIII—XIII.

The refrigerant flowing through the inlet pipe at the part without formation of the enlarged portion 14 becomes a circular flow wherein the gas refrigerant flows at the center portion of the inlet pipe 3 and the liquid refrigerant flows close to the outer periphery of the inlet pipe 3. Therefore, where the enlarged portion 14 is formed at the inlet pipe 3 as in the present embodiment, the flow rate of the refrigerant flowing through the inlet pipe 3 is lowered at the enlarged portion 14, and therefore, as shown in FIG. 13 (cross-sectional view of the refrigerant evaporator 1), a liquid refrigerant having a large density flows into the enlarged portion 14 by the function of gravity, whereby the refrigerant flows into the liquid accumulation chamber 10 in a state where the gas refrigerant and liquid refrigerant are vertically separated to a certain extent. Note that, so as to perform a certain degree of gas and liquid separation in the enlarged portion 14, it is necessary to sufficiently lower the flow rate of the refrigerant before it flows into the liquid accumulation chamber 10. Therefore, in the present embodiment, the depth H of the enlarged portion 14 was set to 20 mm and the length S of the enlarged portion 14 was set to 20 mm (refer to FIG. 13).

The refrigerant striking the inner wall surface of the liquid accumulation chamber 10 is separated into a gas and liquid by the function of the downward inertia force and gravity, whereby a liquid refrigerant having a large density is accumulated as it is in the liquid accumulation chamber 10, and a gas refrigerant having a small density rises and flows into the gas accumulation chamber 11. In this way, before the refrigerant flowing in from the inlet pipe 3 strikes the inner wall surface of the liquid accumulation chamber 10, the gas and liquid separation is carried out in the enlarged portion 14 to a certain extent, whereby the gas and liquid separation at the gas and liquid separation chamber 2 is promoted, so that it becomes possible to perform a sufficient gas and liquid separation.

Figure 14:
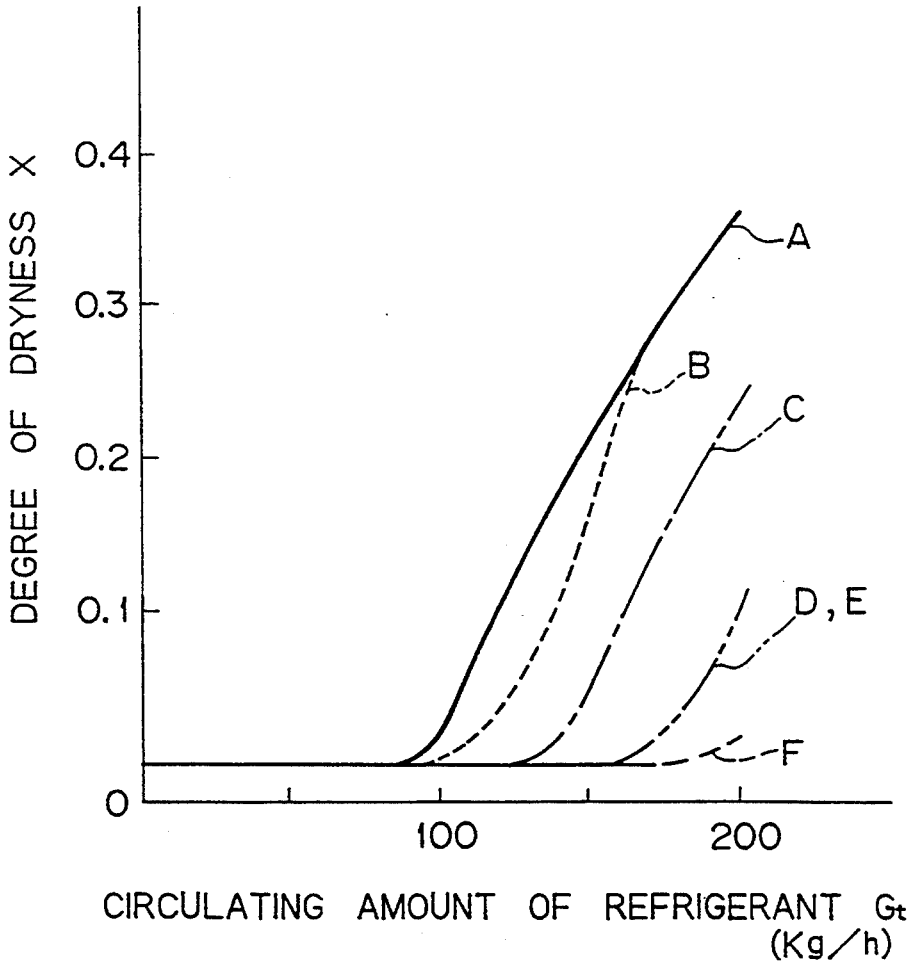
FIG. 14 is a graph showing a gas and liquid separation effect of the second embodiment.
Figure 15:
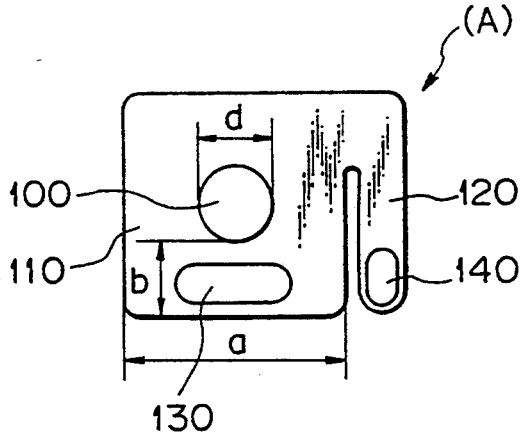
FIG. 15 is a front view of a separator for measurement.
Figure 16:
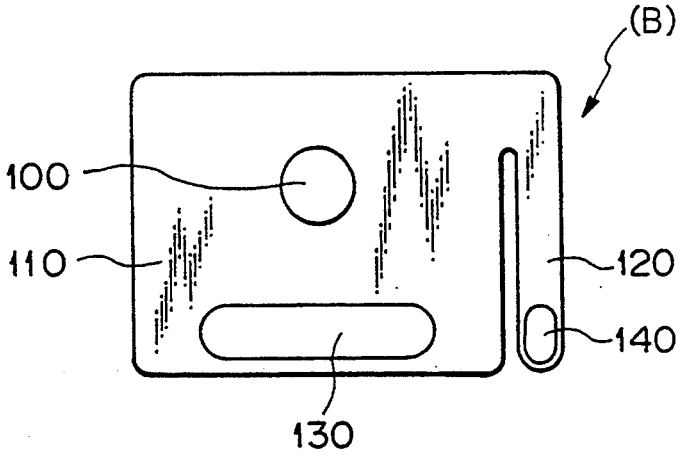
FIG. 16 is a front view of another separator for the measurement.
Figure 17:
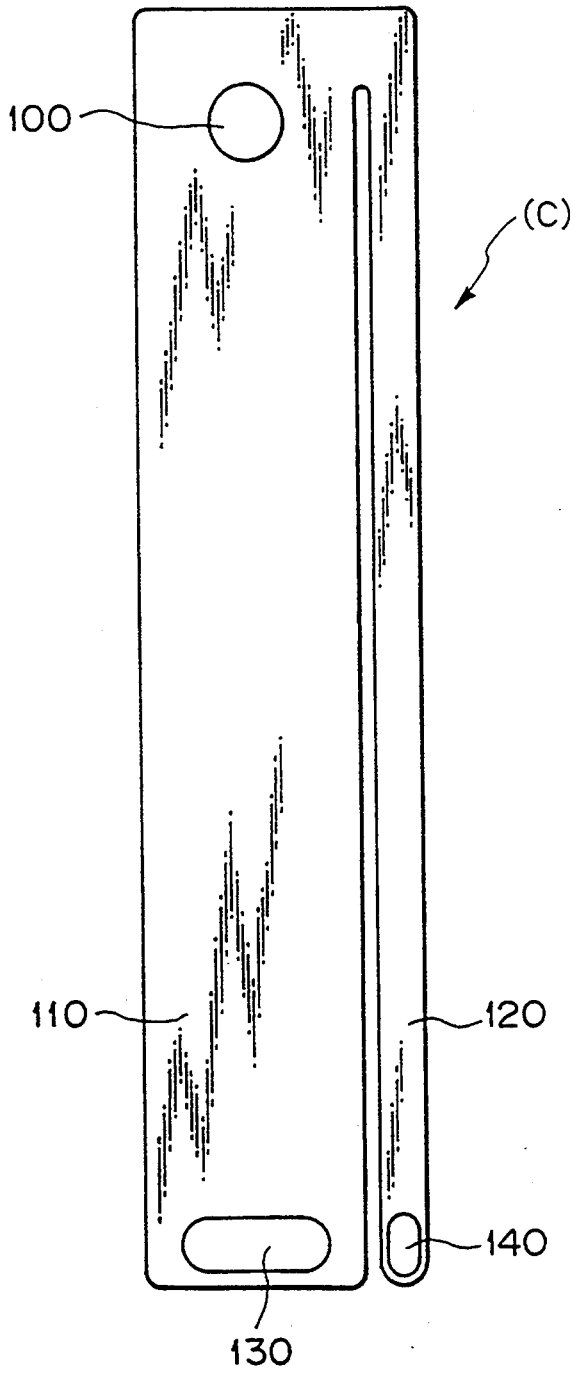
FIG. 17 is a front view of still another separator for the measurement.
Figure 18:
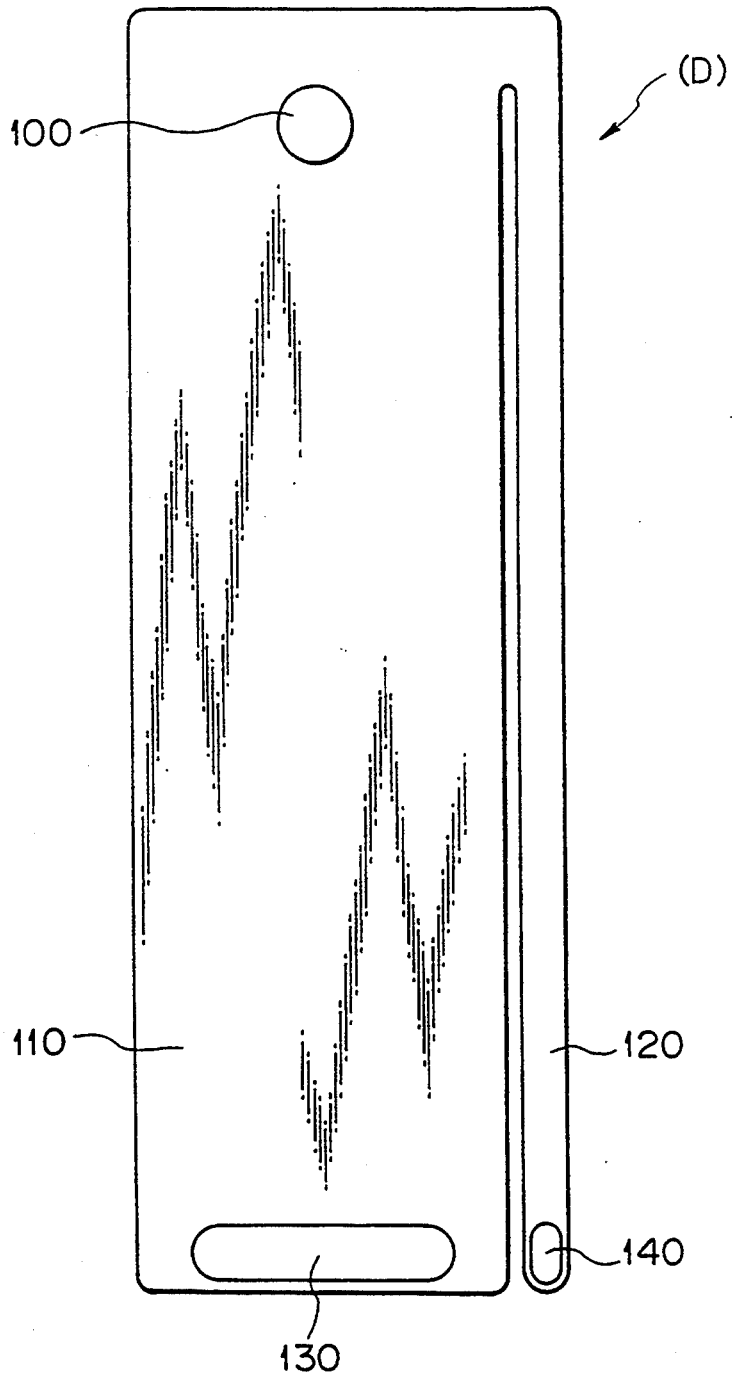
FIG. 18 is a front view of still another separator for the measurement.
Figure 19:
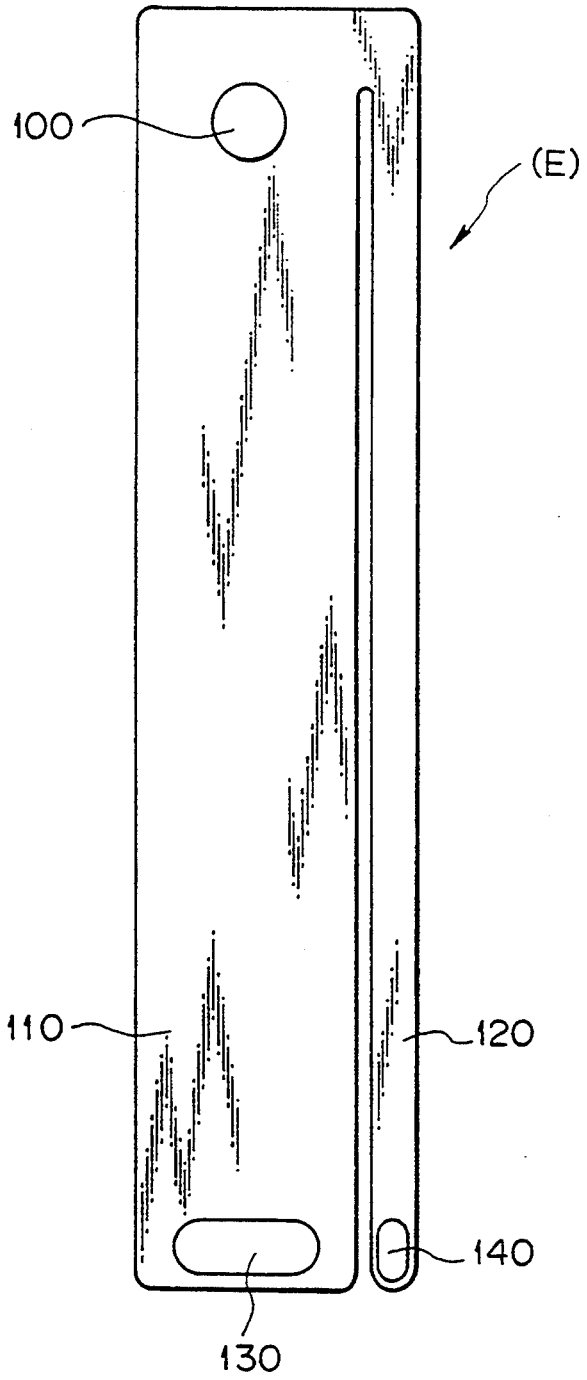
FIG. 19 is a front view of a further separator for the measurement.
Figure 20B:
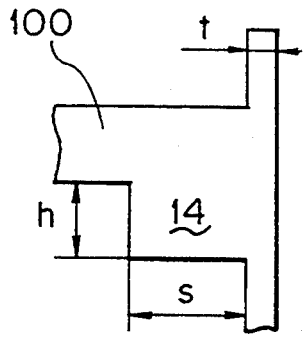
FIG. 20B is a cross-sectional view taken along a line B—B in FIG. 20A.
Figure 20A:
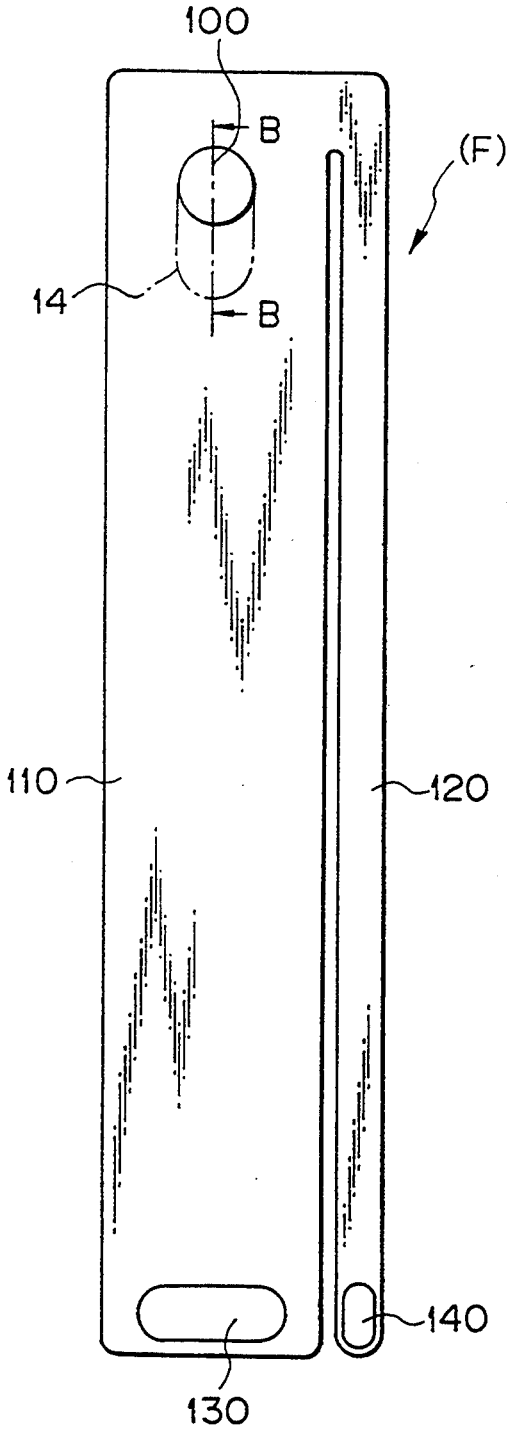
FIG. 20A is a front view of still another separator for the measurement.

Here, the effect of the gas and liquid separation by the provision of the enlarged portion 14 at the inlet pipe 3 is shown in FIG. 14. The graph shown in FIG. 14 represents the amount of the gas refrigerant (degree of dryness) contained in the liquid refrigerant after the gas and liquid separation in a case where the enlarged portion 14 is provided at the inlet pipe 3 and a case where the enlarged portion 14 is not provided and shows that the smaller the degree of dryness with respect to the amount of the circulated refrigerant, the larger the effect of the gas and liquid separation.

So as to measure this degree of dryness, six types of measurement separators (A) to (F) shown in FIG. 15 through FIG. 20 were prepared. These measurement separators (A) to (F) are each provided with an inlet 100 through which the refrigerant flows in; a liquid accumulation chamber 110 in which the liquid refrigerant subjected to the gas and liquid separation is accumulated; and a gas accumulation chamber 120 for accumulating the gas refrigerant. At the lower portion of the liquid accumulation chamber 110 and the lower portion of the gas accumulation chamber 120, a liquid outlet 130 and a gas outlet 140 are provided, respectively. An enlarged portion 14 was provided at the inlet 100 only in the measurement separator (F) shown in FIG. 20. By using these measurement separators, the degree of dryness of the liquid refrigerant flowing out of the liquid outlet 130 was measured under the same conditions (the degree of dryness of the refrigerant flowing in from the inlet 100: $X_t=0.4$; and the proportion of the flow rate $G_b$ of refrigerant flowing out of the liquid outlet 130 with respect to the refrigerant circulation amount $G_t$ flowing in from the inlet 100: $G_b/G_t=0.45$).

Where it is assumed that the inlet diameter is d, a lateral width of the liquid accumulation chamber 110 is a, a height from the inlet 100 to the bottom portion of the liquid accumulation chamber 110 is b, a depth (thickness) of the liquid accumulation chamber 110 is t, a depth of the enlarged portion 14 is h, and a length of the enlarged portion 14 is s, the shapes of the measurement separators (A) to (F) are set as follows:

Measurement separator (A): d=10, a=30, b=10 and t=2;

Measurement separator (B): d=10, a=50, b=20 and t=2;

Measurement separator (C): d=10, a=30, b=150 and t=2;

Measurement separator (D): d=10, a=50, b=150 and t=2;

Measurement separator (E): d=10, a=30, b=150 and t=4;

Measurement separator (F): d=10, a=30, b=150, t=4, h=10 and s=15.

According to the results of this measurement, as shown in FIG. 14, in the measurement separators (A) to (E) not provided with the enlarged portion 14, even in the measurement separators (D) and (E) having the highest gas and liquid separation effect, if the refrigerant circulation amount $G_t$ exceeds 150 kg/h, the degree of dryness X abruptly rises, but in the measurement separator (F) provided with the enlarged portion 14, the degree of dryness X exhibited a low value even though the refrigerant circulation amount $G_t$ was 200 kg/h.

Figure 21:
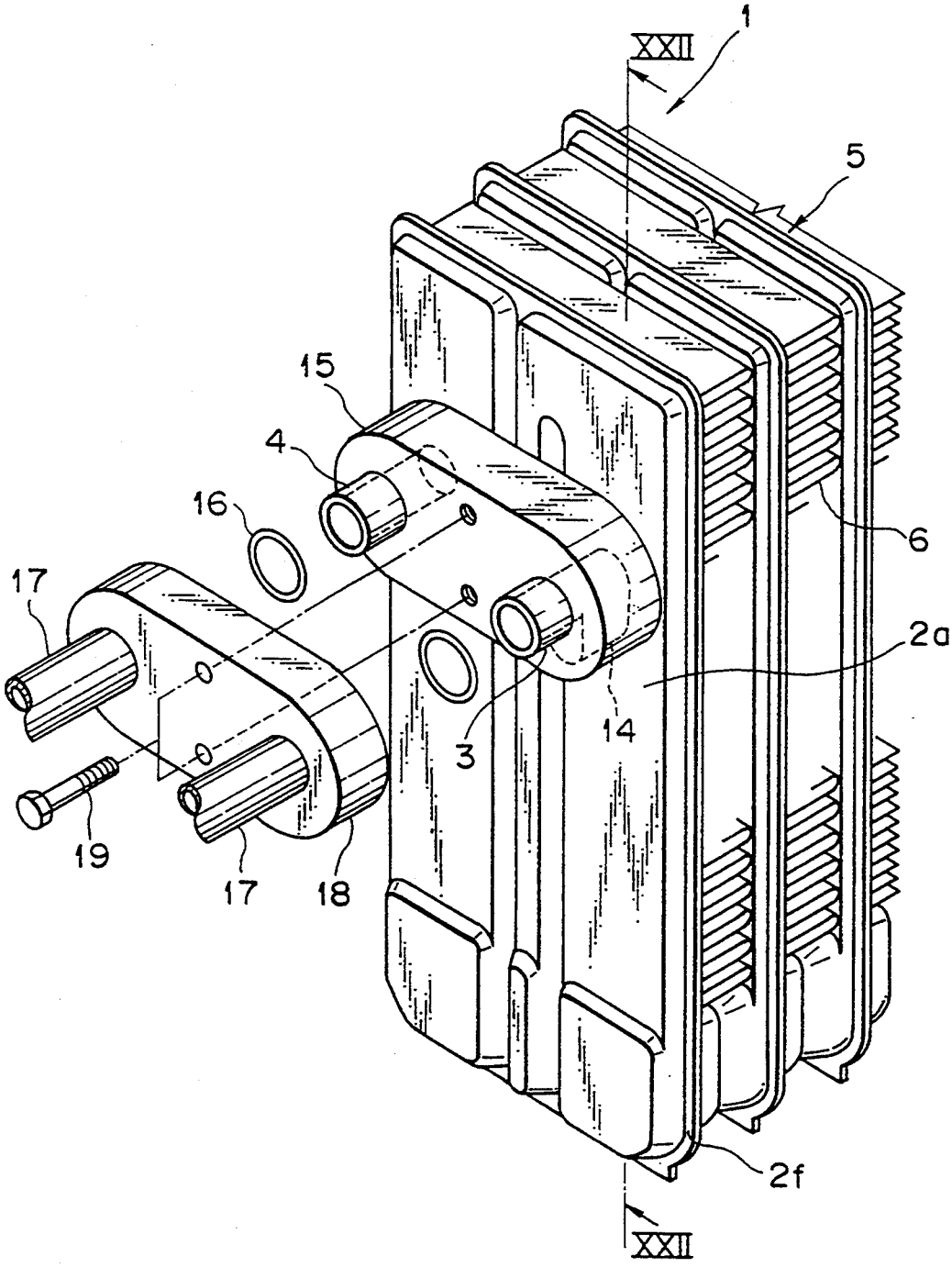
FIG. 21 is a disassembled perspective view of a gas and liquid separation means showing a modified example of the second embodiment.
Figure 22:
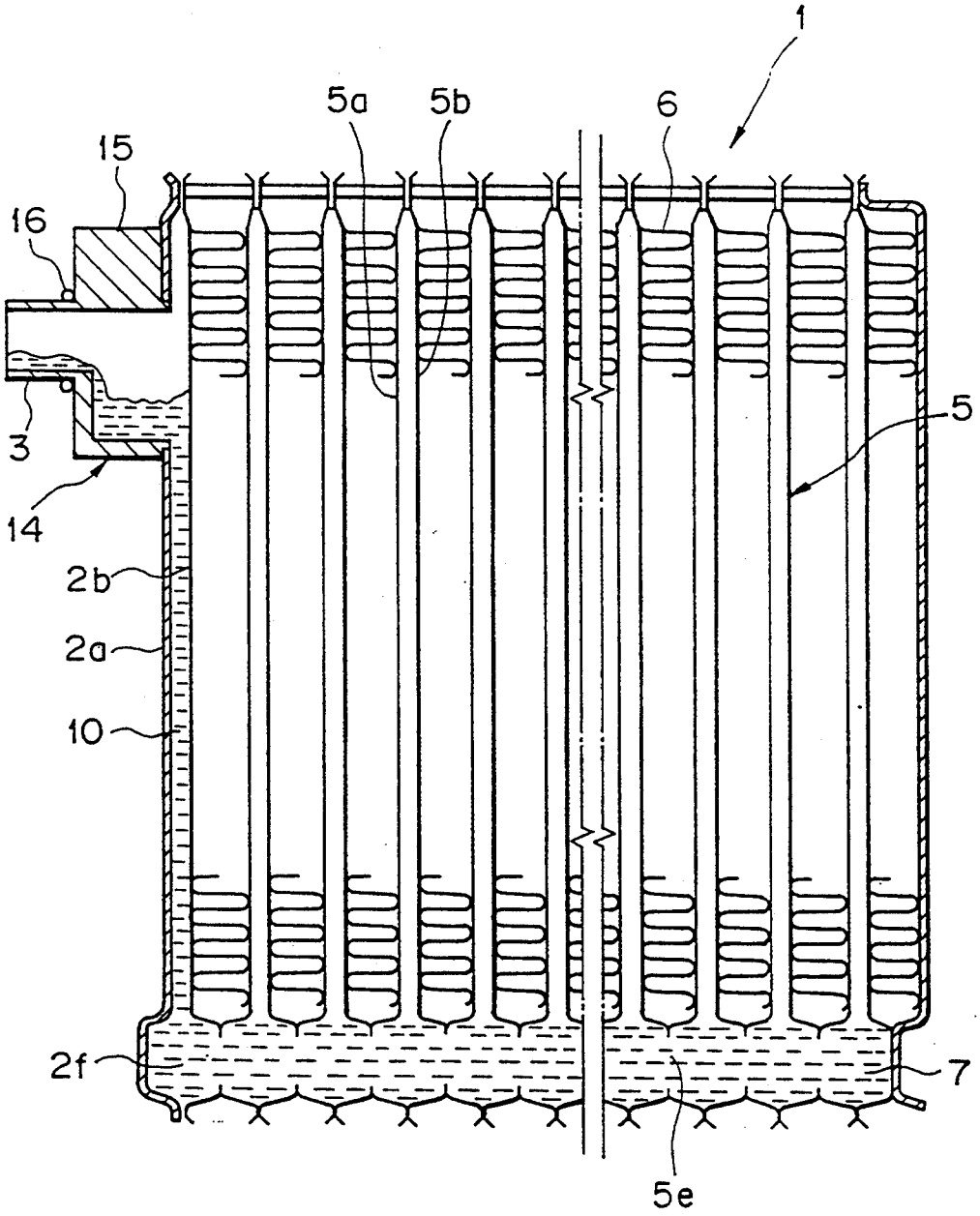
FIG. 22 is a side cross-sectional view of the refrigerant evaporator shown in FIG. 21 taken along a line XXII—XXII.

Note that, in the present embodiment, the inlet pipe 4 and the outlet pipe 4 were directly joined to the plate 2*a* forming the gas and liquid separation chamber 2 by brazing, respectively, but as shown in FIG. 21, it is also possible to form the inlet pipe 3 and the outlet pipe 4 in a block joint 15 and braze that block joint 15 to the plate 2*a*. To the block joint 15, a joint 18 of the refrigerant piping 17 is connected via an O-ring 16 and is fastened by screws 19. Also, the enlarged portion 14 is formed in the block joint 15 while enlarging the cross-sectional surface area of the passageway of the inlet pipe 3 as shown also in FIG. 22 (cross-sectional view of the refrigerant evaporator 1).

An explanation will be made next of the third embodiment of the present invention.

Figure 23:
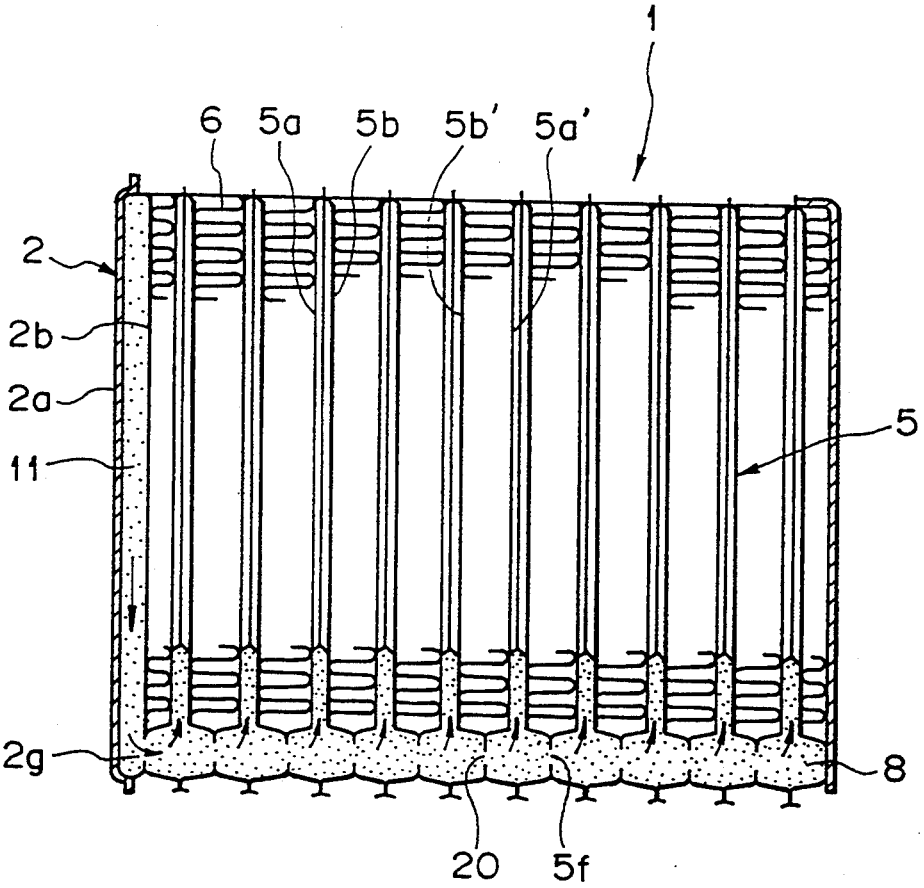
FIG. 23 is a cross-sectional view of the refrigerant evaporator according to a third embodiment taken along a line the same as the line X—X in FIG. 1.

FIG. 23 is a cross-sectional view of the refrigerant evaporator of the third embodiment including the gas accumulation chamber.

Figure 24:
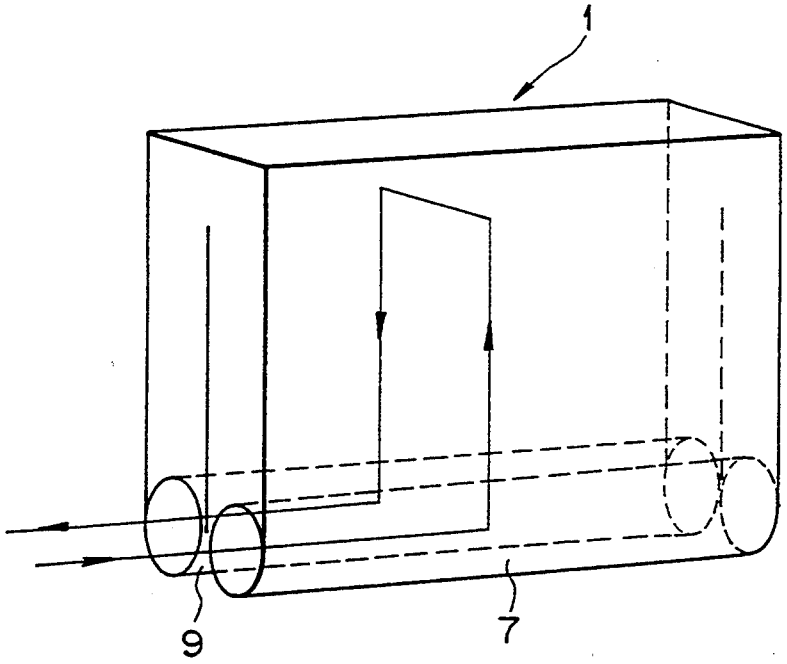
FIG. 24 is a diagrammatical view of a refrigerant evaporator schematically showing the flow of the refrigerant in the first and second embodiments in relation to the third embodiment.
Figure 25:
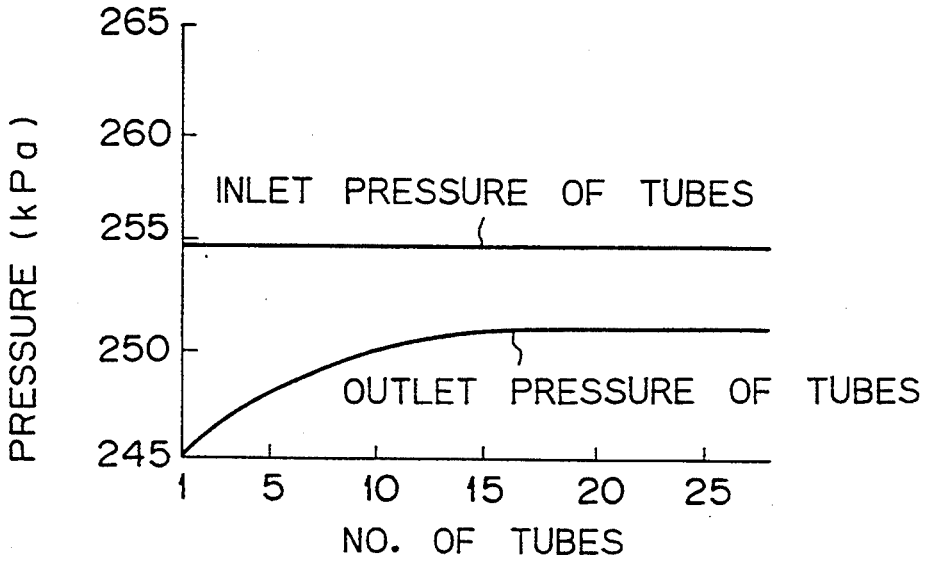
FIG. 25 is a graph similarly showing an inlet pressure and an outlet pressure of the flat tubes.
Figure 26:
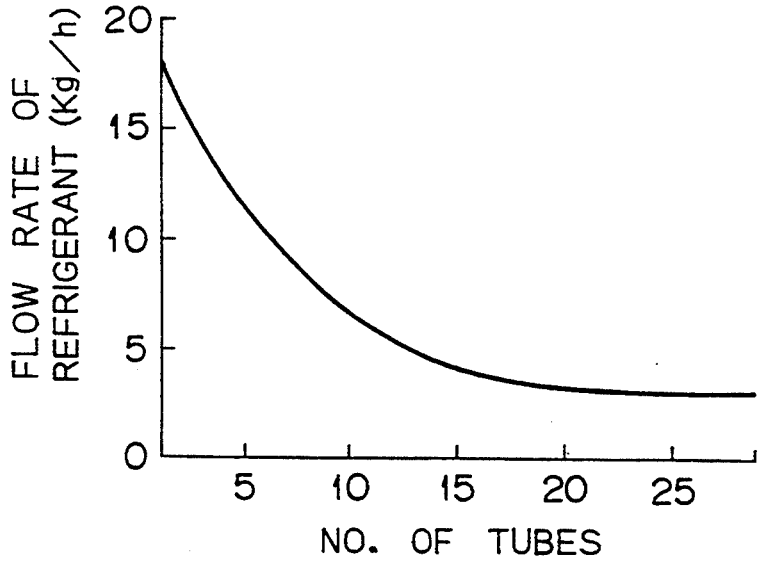
FIG. 26 is a graph similarly showing the flow rate of the refrigerant flowing through the flat tubes.

In the refrigerant evaporator 1 explained in the above-described embodiments, the liquid refrigerant separated in the gas and liquid separation chamber 2 and flowing into the liquid tank 7 of the core portion and the gas refrigerant flowing into the gas tank 8 are distributed to the inside of a large number of flat tubes 5 and then are mixed again and subjected to heat exchange with the surrounding air when flowing through the flat tubes 5. This is then evaporated to become the gas refrigerant, which flows out of the outlet tank 9 (refer to FIG. 24). Accordingly, in the direction of flow of the refrigerant of the tanks 7 and 9 (horizontal direction of FIG. 23), the inlet pressures of the flat tubes 5 (refrigerant pressures before the heat exchange is carried out) become roughly equal since the pressure loss of the refrigerant flowing through the liquid tank 7 is small, but the outlet pressures of the flat tubes 5 (refrigerant pressures after the heat exchange) become lower as the position becomes more downstream (left side of FIG. 23) in the outlet tank 9 since the pressure loss of the refrigerant flowing through the outlet tank 9 is large. As a result, as the pressure difference between the inlet pressure and outlet pressure of the flat tubes 5 becomes larger, the flow rate of refrigerant (liquid refrigerant) flowing through the flat tubes 5 becomes higher (refer to FIG. 26). Accordingly, among a large number of flat tubes 5, one closer to the gas and liquid separation chamber 2 comes to have a higher flow rate of refrigerant flowing therethrough, and one further away from the gas and liquid separation chamber 2 comes to have a smaller flow rate of the refrigerant flowing therethrough.

In this case, in the flat tubes 5, the liquid refrigerant flowing in from the liquid tank 7 and the gas refrigerant flowing in from the gas tank 8 are mixed and then flow on. Therefore, in accordance with the magnitude of the amount of the gas refrigerant flowing in from the gas tank 8 to the flat tubes 5, the amount of the liquid refrigerant flowing in from the liquid tank 7 to the flat tubes 5 will vary.

Therefore, in the present embodiment, at the schematically center portion in the direction of flow of the refrigerant inside the gas tank 8, as shown in FIG. 23, a throttle portion 20 reducing the cross-sectional surface area of the passageway of the gas tank 8 is provided. This throttle portion 20 is formed by using the plates 5*a*′ and 5*b*′ having a reduced opening diameter of the gas tank opening 5*f*. By providing the throttle portion 20 in the gas tank 8, it becomes difficult for the gas refrigerant to flow from the throttle portion 20 to the downstream side (right side from the throttle portion 20 in FIG. 23), and therefore on the downstream side from the throttle portion 20, in comparison with a case where the throttle portion 20 is not provided, the amount of the gas refrigerant flowing from the gas tank 8 into the flat tubes 5 is reduced.

Accordingly, in the right half of the core portion (side far away from the gas and liquid separation chamber 2) which is the downstream side from the throttle portion 20, a two-phase gas and liquid flow with a small amount of gas refrigerant is exhibited, while in the left half of the core portion (side close to the gas and liquid separation chamber 2) which is the upstream side from the throttle portion 20, a two-phase gas and liquid flow with a large amount of gas refrigerant is exhibited. As a result, in the right half of the core portion, the gas refrigerant is reduced, whereby the flow rate of the refrigerant including also the liquid refrigerant is increased, while in the left half of the core portion, the gas refrigerant is increased, whereby the flow rate of the refrigerant including also the liquid refrigerant is reduced. In the core portion as a whole, the flow rate of the refrigerant (particularly the flow rate of the liquid refrigerant) flowing through the flat tubes 5 is made uniform.

Note that, in the present embodiment, the throttle portion 20 was provided only at the one portion in the middle of the gas tank 8, but by providing throttle portions 20 having different opening diameters at suitable positions in the direction of flow of the refrigerant of the gas tank 8, it becomes possible to perform better distribution of the refrigerant in the entire core portion, and the uniformity of the flow rate of the refrigerant can be promoted. Moreover, by completely closing the throttle portion 20, it is also possible to prevent the gas refrigerant from flowing into the flat tubes 5 on the downstream side from that throttle portion 20.

An explanation will be made next of a refrigerant evaporator having a simpler construction than that of the aforementioned first embodiment etc. as a fourth embodiment of the present invention based on FIG. 27 through FIG. 33.

Figure 27:
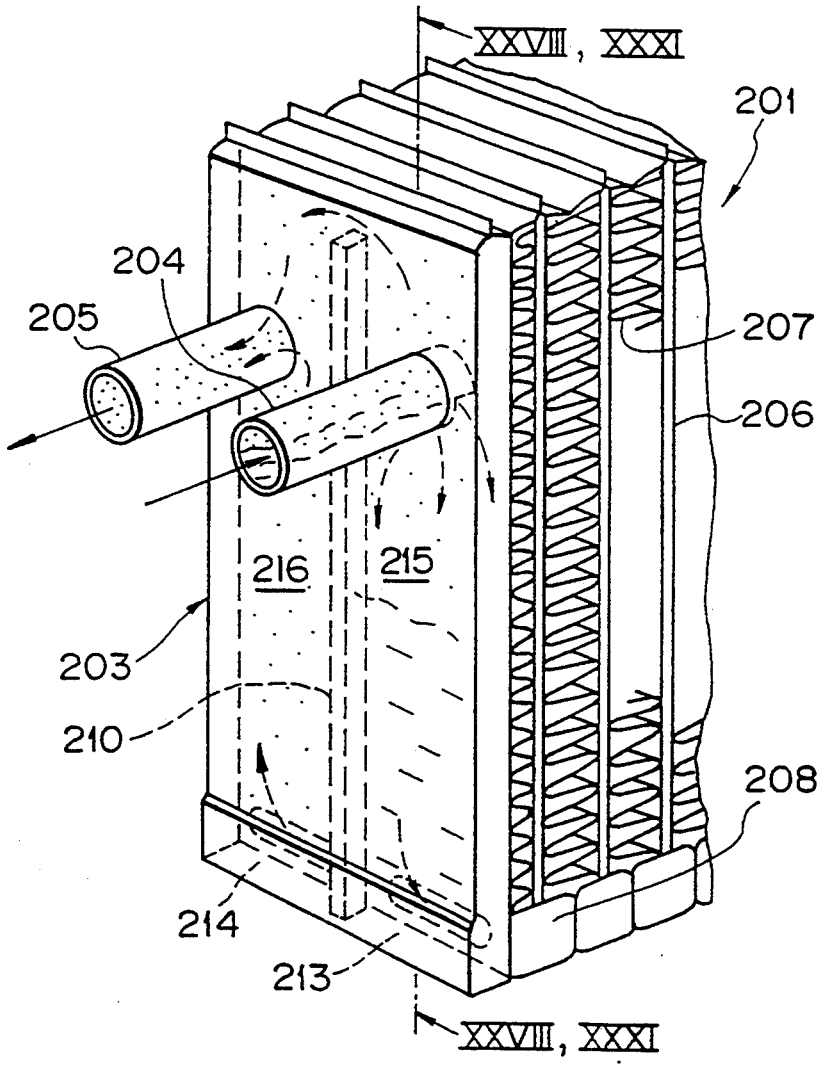
FIG. 27 is a perspective view of a principal part of the refrigerant evaporator according to a fourth embodiment.
Figure 28:
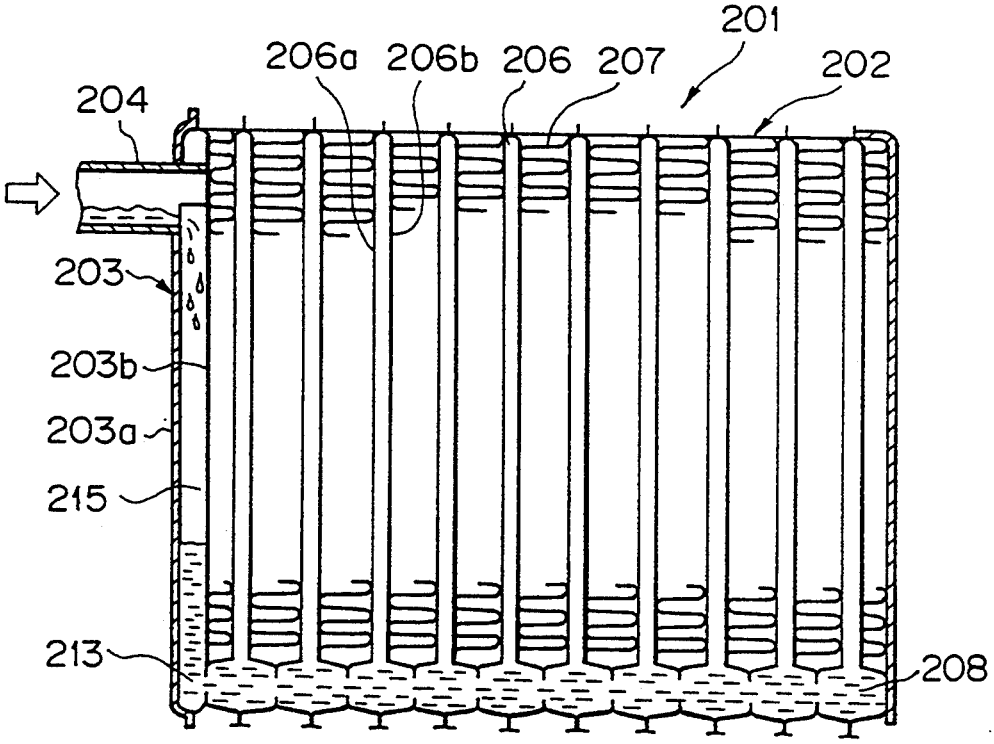
FIG. 28 is a side cross-sectional view of the refrigerant evaporator shown in FIG. 27 taken along a line XXVIII—XXVIII.

FIG. 27 is a perspective view of a principal part of the refrigerant evaporator; and FIG. 28 is a side cross-sectional view of the refrigerant evaporator.

The refrigerant evaporator 201 of the present embodiment is constituted by a core portion 202 performing the heat exchange between the refrigerant and air (refer to FIG. 28); a gas and liquid separation chamber 203 performing the gas and liquid separation of the refrigerant of a two-phase gas and liquid flow supplied from an expansion valve (not illustrated); an inlet pipe 204 (refrigerant inflow portion) connected to this gas and liquid separation chamber 203; and an outlet pipe 205 (refrigerant outflow portion), made integral by brazing.

As shown in FIG. 28, the core portion 202 comprises an alternate stacking of a large number of flat tubes 206 and fins 207.

The flat tube 206 is formed by placing two plates **206*a* and 206*b* so as to face each other. For the plates 206*a* and 206*b***, brazing sheets obtained by cladding an aluminum brazing material having a low melting point to the two surfaces of a core material (for example A3003) are used.

In this flat tube 206, an inlet pipe 204 and a not illustrated outlet tank are provided at the lowermost portion. At the same time, a refrigerant passageway communicating the inlet pipe 208 and the outlet tank in an inverse U-shape is formed.

The gas and liquid separation chamber 203 comprises two plates **203*a* and 203*b* formed by the brazing sheet in the same way as that of the flat tube 206 and is provided on one (left side of FIG. 28) side end portion in the direction of stacking of the core portion 202**.

Figure 29:
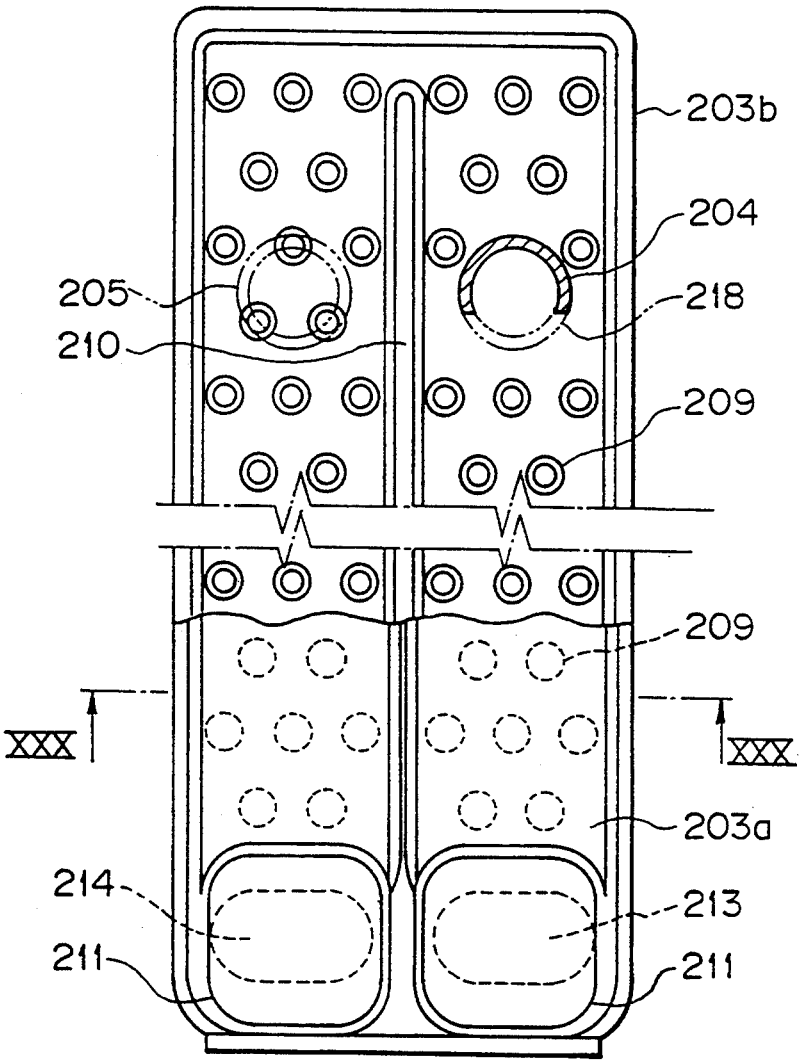
FIG. 29 is a front view of the plate (including the XXIX—XXIX cross-section in FIG. 31)

In the plates **203*a* and 203*b*, as shown in FIG. 29, a large number of dimples 209 are formed at the surface thereof by press-forming. At the same time, a rib 210 is provided extending in the vertical direction at the center portion. At the lowermost portions on the two sides of the plates 203*a* and 203*b* partitioned by the rib 210, expansion portions 211 and 212 (refer to FIG. 31**) are provided.

Figure 30:
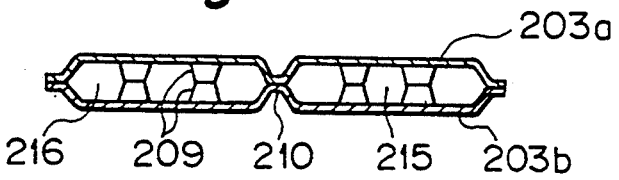
FIG. 30 is the XXX—XXX cross-sectional view in FIG. 29.

The two plates **203*a* and 203*b* are brazed in a state with the dimples 209 and ribs 210 facing each other as shown in FIG. 30, to form a flat gas and liquid separation chamber 203. In this gas and liquid separation chamber 203, tank portions 213 and 214 are formed by expansion portions 211 and 212 and, at the same time, a vertically long inlet side chamber 215 and outlet side chamber 216 partitioned by the rib 210, and the inlet side chamber 215 and outlet side chamber 216 are communicated with the tank portion 213 and the tank portion 214, respectively. Also, the inlet side chamber 215 and the outlet side chamber 216 are communicated at the uppermost portion not provide with the rib 210**.

In this gas and liquid separation chamber 203, the tank portion 213 and the tank portion 214 are connected to an inlet tank 208 and an outlet tank, respectively, and accordingly the inlet side chamber 215 and the outlet side chamber 216 are communicated with the inlet tank 208 and the outlet tank of the core portion, respectively.

The inlet pipe 204 and the outlet pipe 205 are inserted into holes provided above the plates **203*a*, respectively, so as to be communicated with the inlet side chamber 215 and the outlet side chamber 216 of the gas and liquid separation chamber 203 and are joined by brazing to the plate 203*a* by the barring portions 217 (refer to FIG. 31**) formed at the front end portions of the pipes.

Figure 31:
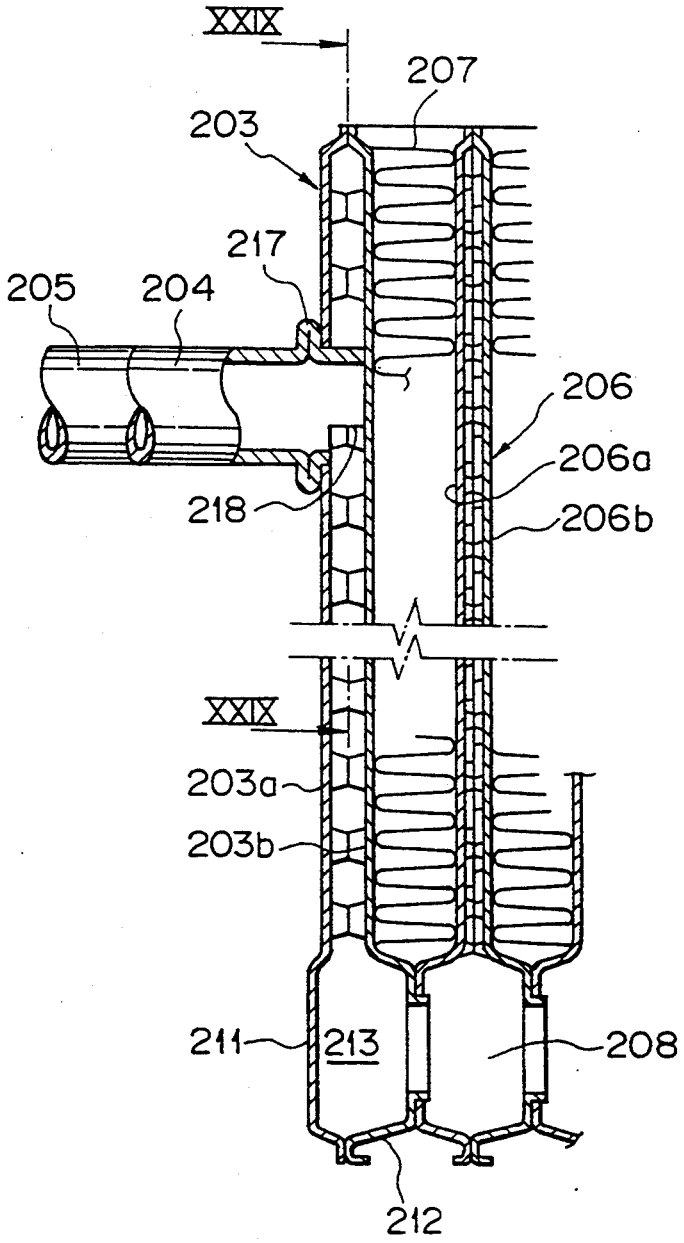
FIG. 31 is a side cross-sectional view of the gas and liquid separation chamber shown in FIG. 27 taken along a line XXXI—XXXI.

The front end side of the inlet pipe 204 projects from the barring portion 217 and is inserted into the inlet side chamber 215 until the front end surface abuts against the inside plate **203*b*. At the projected front end portion, as shown in FIG. 29 and FIG. 31, a recess portion 218** opened downward is formed.

Note that, the outlet pipe 205 is not inserted to the interior of the outlet side chamber 216, but is provided so that the front end surface thereof becomes the same plane as the inner wall surface of the outside plate **203*a***.

The operation of the present embodiment will be explained next.

The refrigerant of the two-phase gas and liquid flow reduced in pressure by the expansion valve flows in from the inlet pipe 204 into the inlet side chamber 215 of the gas and liquid separation chamber 203.

Figure 32:
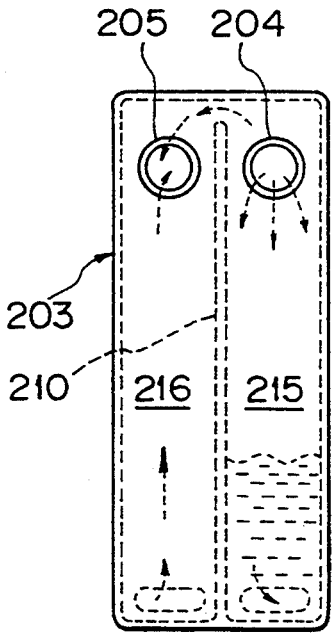
FIG. 32 is a front view of the gas and liquid separation chamber.

Here, since the front end portion of the inlet pipe 204 inserted to the interior of the inlet side chamber 215 is opened downward by the recess portion 218, the refrigerant of the two-phase gas and liquid flow flows downward from the recess portion 218 into the inlet side chamber 215. At this time, due to the action of the downward inertia force and gravity, the liquid refrigerant and the gas refrigerant are separated. As shown in FIG. 32, the liquid refrigerant is accumulated in the inlet side chamber 215 and flows from the tank portion 213 into the inlet tank 208.

The liquid refrigerant filled in the inlet tank 208 is uniformly and equally distributed to the refrigerant passageways of the flat tubes 206, is subjected to heat exchange with the surrounding air when flowing through the refrigerant passageways, and is evaporated. The evaporated gas refrigerant flows through the outlet tank, flows into the tank portion 214, and flows from the tank portion 214 into the outlet side chamber 216.

On the other hand, the gas refrigerant separated at the gas and liquid separation chamber 203 rises as it is in the inlet side chamber 215 and flows into the outlet side chamber 216, is combined with the above-described gas refrigerant, and flows out of the outlet pipe 205.

In this way, in the present embodiment, the liquid refrigerant is uniformly and equally distributed to the flat tubes 206, and thus the refrigerant does not become excessive or short in supply among the flat tubes 206, and therefore it is possible to effectively utilize the refrigerant evaporator 201 to the highest extent.

The equal distribution of the refrigerant to the flat tubes 206 becomes possible by merely adding the gas and liquid separation chamber 203 formed by two plates **203*a* and 203b**, without the need for major modification of the cycle.

Figure 33:
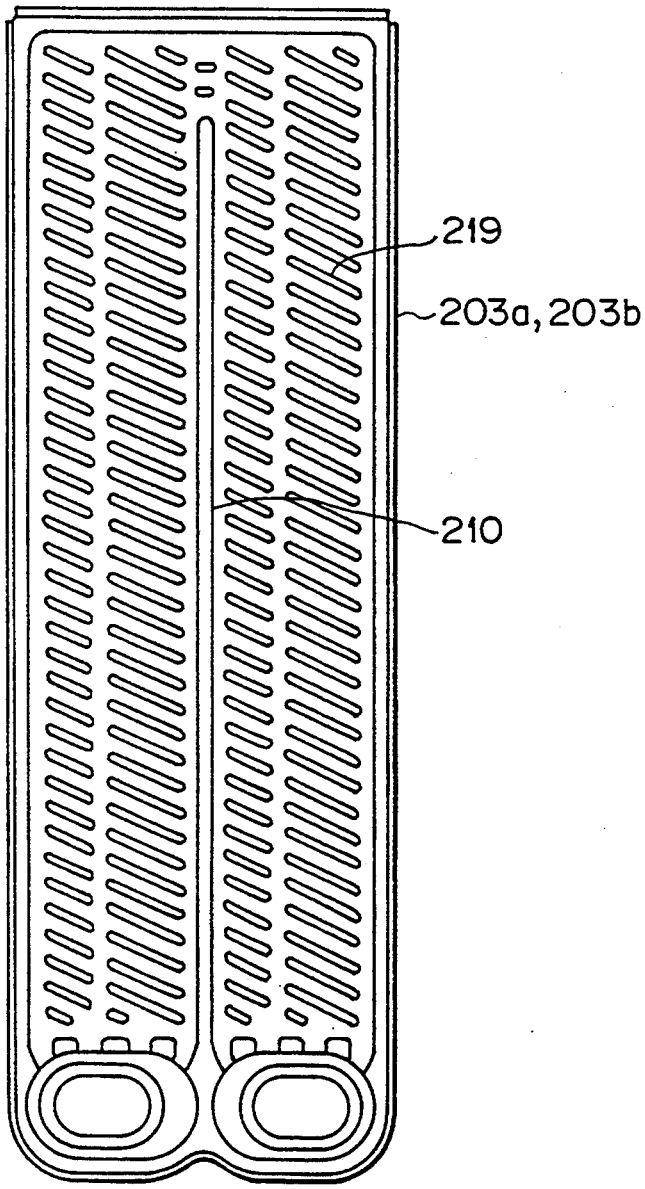
FIG. 33 is a front view showing the modified example of the plate.

In the present embodiment, the dimples 9 were provided on the surface of the plates **203*a* and 203*b*, but, as shown in FIG. 33, it is also possible to provide a large number of inclined ribs 219 and join the ribs 219** at mutual intersecting points of the same.

A fifth embodiment of the present invention will be explained next based on FIG. 34 and FIG. 35.

Figure 34:
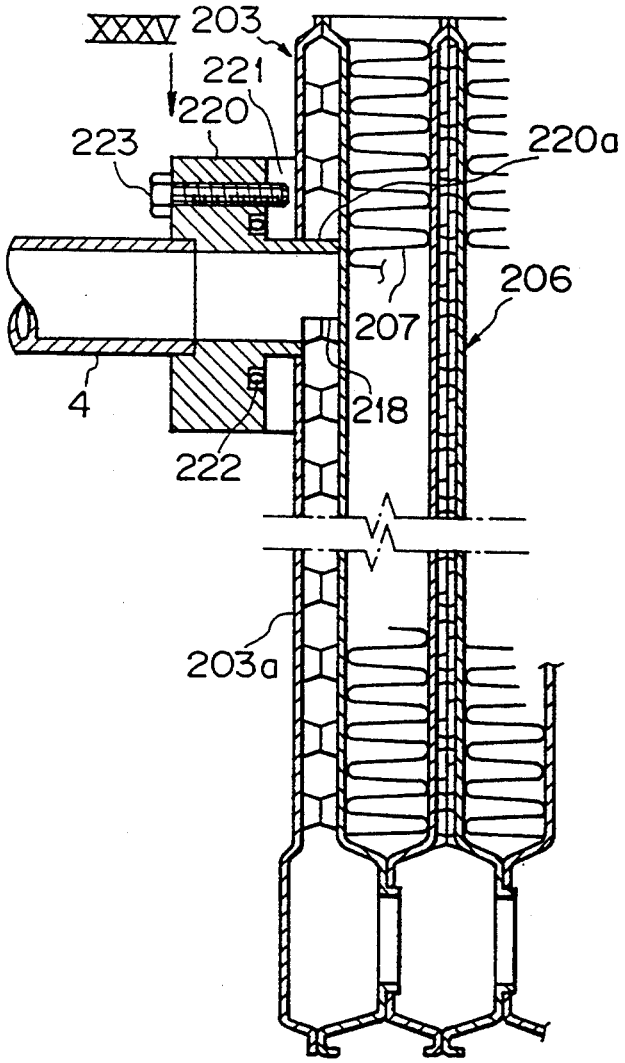
FIG. 34 is a side cross-sectional view of the gas and liquid separation chamber according to a fifth embodiment of the present invention in a cross-section similar to that of FIG. 31.
Figure 35:
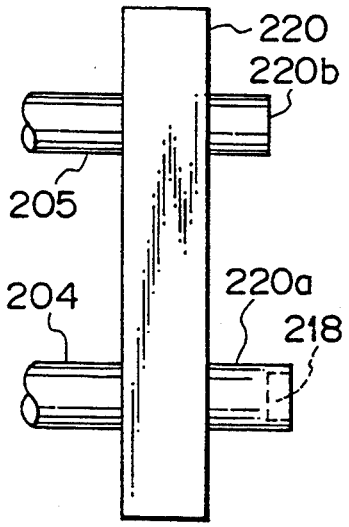
FIG. 35 is a plan view of a block seen in a direction shown by an arrow XXXV in FIG. 34.

FIG. 34 is a cross-sectional view of a gas and liquid separation chamber; and FIG. 35 is a plan view seen in the direction indicated by an arrow of XXXV of FIG. 34.

In the present embodiment, the inlet pipe 204 and the outlet pipe 205 are communicated via a block 220 to the gas and liquid separation chamber 203. A relatively thick aluminum plate 221 is brazed to the outside plate 203*a* of the gas and liquid separation chamber 203, and the block 220 is joined to this aluminum plate 221 via an O-ring 222 by a bolt 223.

Note that, in the block 220, projection portions 220*a* and 220*b* to be inserted into the gas and liquid separation chamber 203 are formed by a method such as cutting, and a recess portion 18 opened downward is formed in the projection portion 20*a* on the inlet pipe 4 side.

Figure 36:
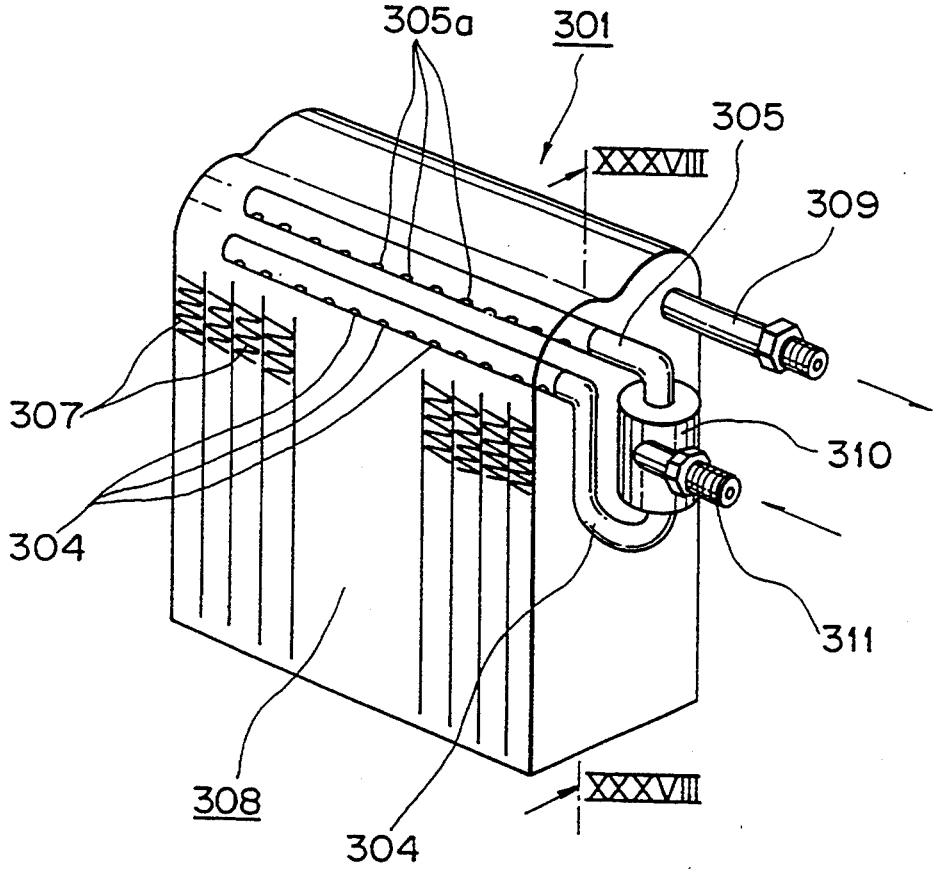
FIG. 36 is a schematic perspective view of the refrigerant evaporator according to a sixth embodiment of the present invention.
Figure 37:
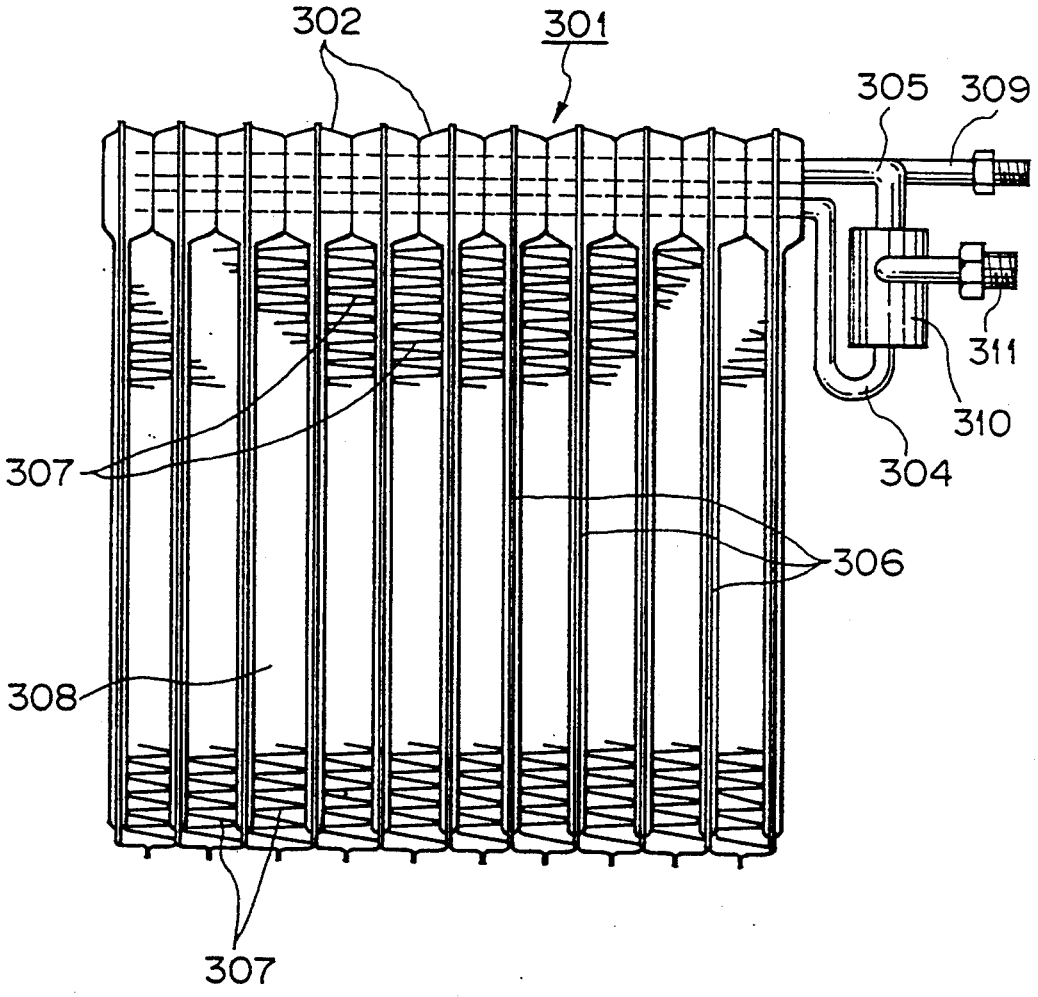
FIG. 37 is a side view of the refrigerant evaporator shown in FIG. 36.
Figure 38:
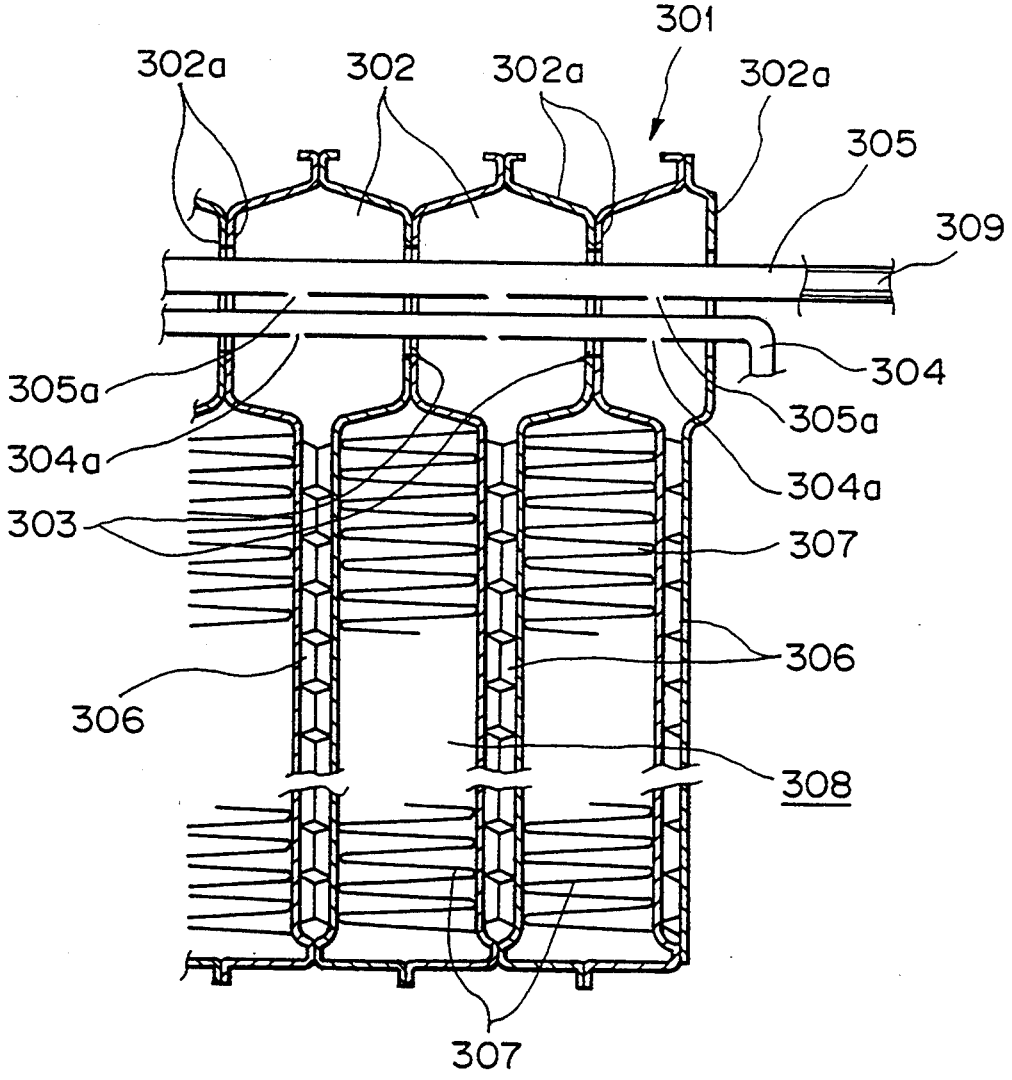
FIG. 38 is an enlarged cross-sectional view of the principal part in FIG. 36 taken along a line XXXVIII—XXXVIII.

A sixth embodiment of the present invention will be explained next referring to FIG. 36 to FIG. 38. FIG. 38 is a schematic perspective view of a multiple path type refrigerant evaporator (hereinafter simply referred to as an evaporator) according to the sixth embodiment; FIG. 37 is a side view; and FIG. 38 is an enlarged cross-sectional view of a principal part. Above the main body 301 of the evaporator, a plurality of independent tanks 302 are arranged in a lateral alignment. Communication ports 303 are formed in partition walls 302*a* of the adjoining tanks 302. A liquid refrigerant distributing and supplying conduit 304 and a gas refrigerant distributing and supplying conduit 305 are horizontally inserted into the communication ports 303 and are brazed to the partition wall 302*a* of the tanks 302 on both of left and right sides. The liquid refrigerant distributing and supplying conduit 304 is made to have a slightly smaller conduit diameter than the gas refrigerant distributing and supplying conduit 305. Refrigerant supply ports 304*a* having a diameter of about 1 mm are formed corresponding to the tanks 302.

Moreover, also in the gas refrigerant distributing and supplying conduit 305, refrigerant supply ports 305*a* having a diameter of about 2 mm are formed corresponding to the tanks 302. At the bottom portion of each tank 302, a refrigerant passageway 306 through which the refrigerant distributed and supplied to the tank 302 flows down is connected. At the same time, corrugated fins 307 are arranged between the adjoining refrigerant passageways 306, to constitute the heat exchange surface 308. The refrigerant passageway 306 is turned up at the bottom portion of the main body 301 of the evaporator and communicated to a tank (not illustrated) provided separately from the aforesaid tanks 302 to enable the refrigerant evaporated by the heat exchange to flow out through an outflow conduit 309.

A centrifugal separator 310 is added to the aforesaid main body 301 of the evaporator. A refrigerant which reduced in pressure by the expansion valve (not illustrated) and made a two-phase gas and liquid state is introduced from a refrigerant introduction nozzle 311 and is separated into the liquid refrigerant and the gas refrigerant. The aforesaid gas refrigerant distributing and supplying conduit 305 is connected to the upper surface of the centrifugal force separator 310, and the separated gas refrigerant is distributed and supplied to the aforesaid tanks 302. Also, at the bottom surface of the centrifugal force separator 310, the aforesaid liquid refrigerant distributing and supplying conduit 304 is bent in a U-shape and connected. The separated liquid refrigerant is distributed and supplied to the aforesaid tanks 302 through this.

An explanation will be made below of the operation of the evaporator having the above-described structure. The refrigerant circulating through the refrigeration cycle is reduced in pressure by the expansion valve and introduced into the centrifugal force separator 310 in the two-phase gas and liquid state. The liquid refrigerant separated at the cehtrifugal force separator 310 flows out to the liquid refrigerant distributing and supplying conduit 304 and is uniformly and equally distributed and supplied from the refrigerant supply port 304*a* to the tanks 302. Also, the gas refrigerant to which a partial liquid refrigerant flowing out to the gas refrigerant distributing and supplying conduit 305 has been mixed is almost uniformly and equally distributed and supplied from the refrigerant supply port 305*a* to the tanks 302. The liquid refrigerant and gas refrigerant (partially included in the liquid refrigerant) uniformly and equally distributed and supplied to the tanks 302 absorb heat while flowing down through the refrigerant passageways 306 and evaporating, reach the bottom portion of the main body 301 of the evaporator, then are turned around and flow into the tank (not illustrated) provided above, flows out of the outflow conduit 309, and go toward the compressor.

The aforesaid liquid refrigerant distributing and supplying conduit 304 is designed to have a smaller conduit diameter than that of the gas refrigerant distributing and supplying conduit 305 and allows only the liquid refrigerant to flow out. It uniformly and equally distributes and supplies the liquid refrigerant from the refrigerant supply port 304*a* to the tanks 302. For this reason, the amount of the liquid refrigerant flowing down through the refrigerant passageways 306 becomes constant without leaning to any one passageway, and therefore the heat exchange performance becomes uniform on the entire heat exchange surface 308, and consequently the cooling performance is improved. On the other hand, part of the liquid refrigerant flows out to the gas refrigerant distributing and supplying conduit 305 together with the gas refrigerant and is supplied from the refrigerant supply port 305*a*, and therefore the distribution and supply of the refrigerant becomes uncertain and it becomes impossible to uniformly and equally supply it, but the amount of the liquid refrigerant in this case is very small, and therefore the effect on the lowering of the cooling performance is small. Also, the tanks 302 are communicated by the communication holes 303 provided in the partition walls 302*a*, and therefore the refrigerant supply port 305*a* of the gas refrigerant distributing and supplying conduit 305 is not always necessary. It is also sufficient if a gas refrigerant distributing and supplying conduit with a front end which is merely opened is inserted into any one tank 302.

Note that, in this case, there arises no problem even if an evaporator of a serpentine type, tube and fin type, etc. is used so far as the evaporator is a multiple path type evaporator. Moreover, it is also possible to adopt, as the gas and liquid separator, an impinging separation type or the tank type provided with the gas and liquid separation chamber as shown in the aforementioned embodiment other than the centrifugal force separator of the above-described embodiment.

A seventh embodiment of the present invention will be explained referring to FIG. 39 to FIG. 41. In the case of the previously explained first embodiment, the construction was made so that, as shown in FIG. 2 and FIG. 3, the liquid refrigerant and gas refrigerant separated inside the gas and liquid separation chamber 2 flowed into a liquid tank 7 and a gas tank 8 formed adjoining at the lower portion of the flat tube 5, the fluids were distributed from these tanks to the refrigerant passageways, and further the liquid refrigerant and the gas refrigerant were combined inside the refrigerant passageways. In the case of the first embodiment, further, also an outlet tank 9 is formed other than the liquid tank 7 and the gas tank 8 at the lower portion of the flat tube 5, and therefore it is necessary to form a part corresponding to these three tanks at the lower end portion of the plate 5, and a problem such that the press-forming of the plate 5 becomes slightly difficult occurs. The seventh embodiment offers an improvement on this point.

Figure 39:
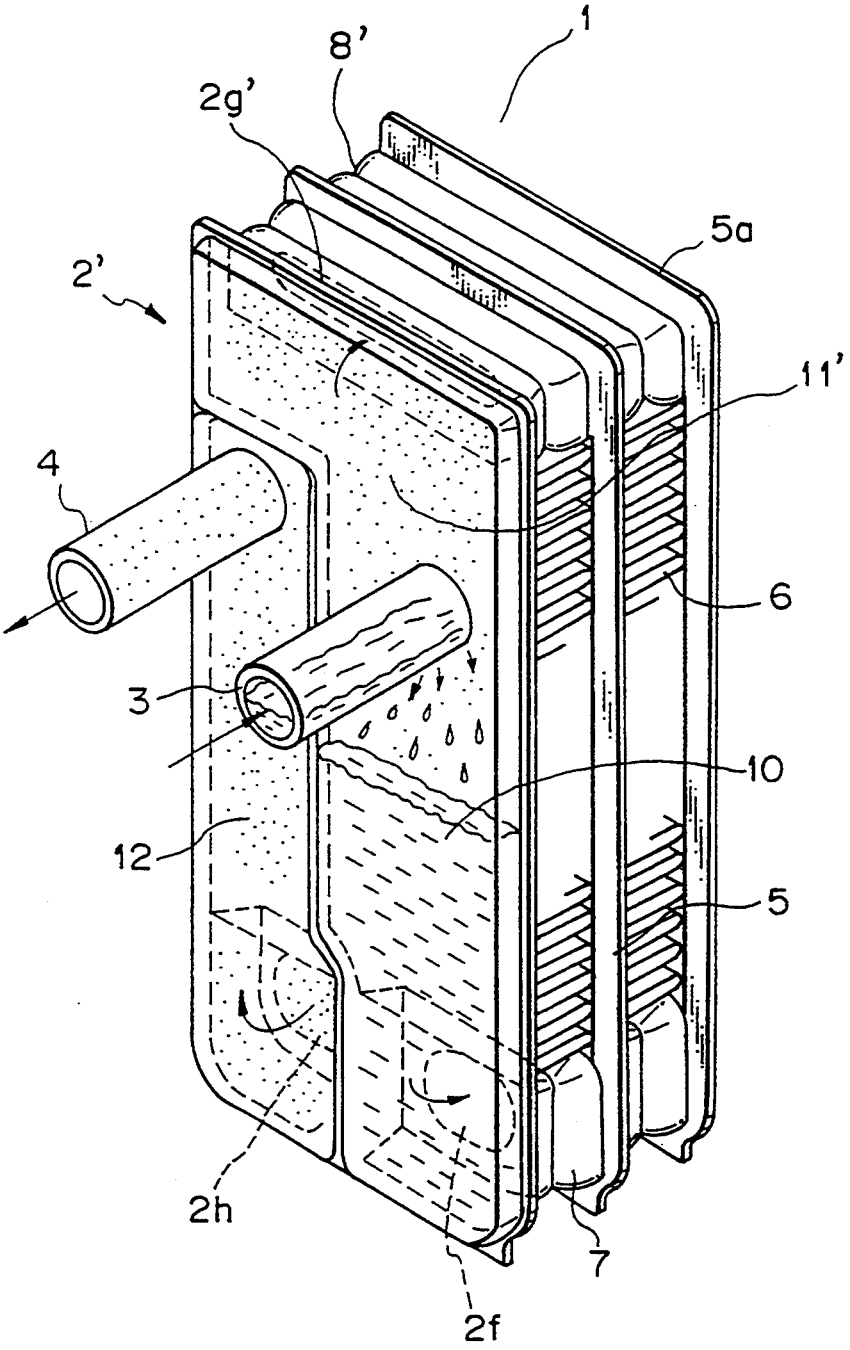
FIG. 39 is a perspective view of the gas and liquid separation chamber and the evaporation portion according to a seventh embodiment of the present invention.

As shown in FIG. 39, the gas and liquid separation chamber 2' in the refrigerant evaporator 1 of the seventh embodiment has a simple construction in which only the liquid accumulation chamber 10 is formed at the bottom. At the same time, a gas accumulation chamber 11' is formed above, and an outlet chamber 12 is formed separately from them. The plate **5*a* forming the refrigerant passageway of the evaporation portion is given a shape as shown in FIG. 40 and FIG. 41 by press-forming, and therefore the evaporation portion can be constituted by stacking sets of stacks of these two plates so as to face each other. In the lower portion of each plate 5*a*, an expanded part and a hole constituting the liquid tank 7 and outlet tank 9 are formed symmetrically in the horizontal direction. A partition rib 5*c* extended vertically from a space therebetween to near the upper portion divides the space into two left and right refrigerant passageways. In the upper portion of each plate 5*a*, an expanded part and a hole constituting the gas tank 8'** are formed.

When the refrigerant of a two-phase gas and liquid state supplied from the pressure reduction means such as a not illustrated expansion valve flows in from the inlet pipe 3 and strikes the wall surface of the gas and liquid separation chamber 2', the liquid refrigerant separated by the action of gravity is accumulated in the liquid accumulation chamber 10 at the bottom of the gas and liquid separation chamber 2' and, at the same time, the gas refrigerant is accumulated in the upper gas accumulation chamber 11'. The liquid refrigerant can flow in from the liquid side opening **2*f* at the bottom of the gas and liquid separation chamber 2' into the liquid tank 7 of the evaporation portion. It is composed of only the homogeneous liquid refrigerant not including gas refrigerant, and therefore is uniformly and equally distributed to the lower portion of the refrigerant passageways (flat tubes) 5 on one side of the vertical partition rib 5 at the center formed on the plate 5*a***.

On the other hand, the gas refrigerant accumulated in the gas accumulation chamber 11' above the gas and liquid separation chamber 2' passes through the gas side opening **2*g'* and flows into the gas tank 8' formed by the upper portions of the plates 5*a*, but this is composed of only the gas refrigerant not including the liquid refrigerant, and therefore is uniformly and equally distributed to the upper portion of the refrigerant passageways (flat tubes) 5. Accordingly, the gas refrigerant will be combined with the liquid refrigerant inside the refrigerant passageway at the upper portion of the evaporation portion of the refrigerant evaporator 1. The combined refrigerant flows down through the refrigerant passageway on an opposite side of the partition rib 5*c* and gathers in the outlet tank 9, passes through the outlet side opening 2*h* and outlet chamber 12 of the gas and liquid separation chamber 2', and flows out of the outlet pipe 4. In this way, the refrigerant is vaporized during the time it flows through the refrigerant passageways of the refrigerant evaporator 1 and becomes a completely gas refrigerant. This robs the heat of the air flowing between the corrugated fins 6**.

Figure 40:
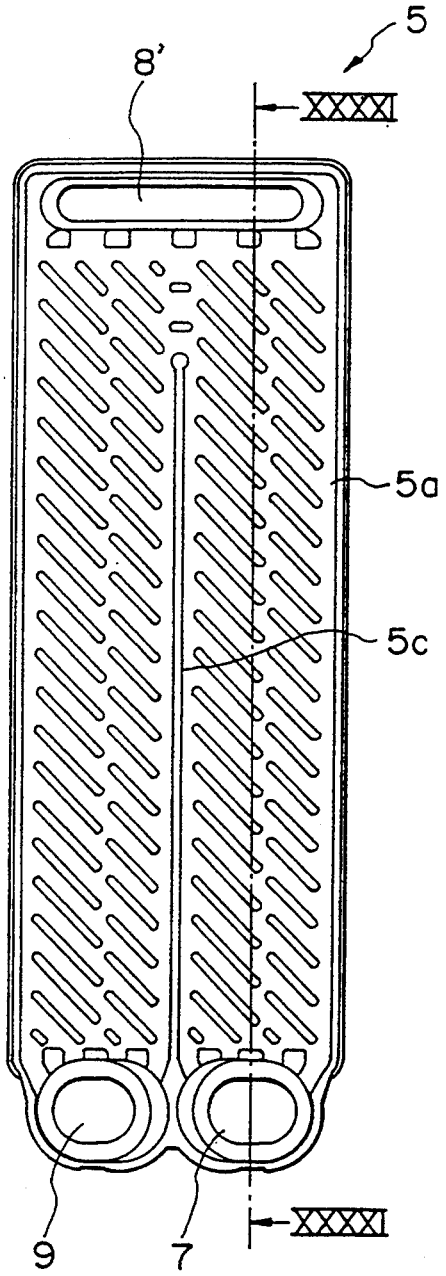
FIG. 40 is a front view of the plate constituting the flat tube shown in FIG. 39.
Figure 41:
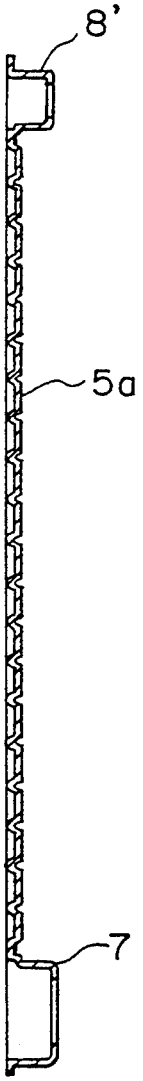
FIG. 41 is a side cross-sectional view of the plate shown in FIG. 40 taken along a line XXXXI—XXXXI.

In the seventh embodiment, as shown in FIG. 40, it is sufficient if a part constituting the liquid tank 7 and the outlet tank 9 is merely formed at the lower portion of the plates **5*a*, and therefore there are advantages such that the press-forming of the plate 5*a* becomes easy, and the evaporation portion can be constituted by using only one type of plate 5*a*** and stacking them while alternately changing their directions. These both contribute to the reduction of costs.

We claim:

1. A refrigerant evaporator comprising:

a plurality of refrigerant passageways arranged in parallel and having an upstream side;

at least one fin which is interposed among said plurality of refrigerant passageways and forms a heat exchange portion together with said refrigerant passageways;

a gas and liquid separation means which is formed on a plate being disposed parallel to said plurality of refrigerant passageways so that said gas and liquid separation means is provided integrally with said refrigerant evaporator itself, and which separates a refrigerant of a two-phase gas and liquid state introduced from a pressure reduction means into a liquid refrigerant and a gas refrigerant, and which is provided with a liquid accumulation chamber accumulating the separated liquid refrigerant and a gas accumulation chamber accumulating the separated gas refrigerant;

a liquid tank communicated with said liquid accumulation chamber; and a gas tank communicated with said gas accumulation chamber, the upstream side of said plurality of refrigerant passageways being branched to liquid refrigerant passageways and gas refrigerant passageways, said liquid refrigerant passageways being communicated with said liquid tank on the upstream side, and said gas refrigerant passageways being communicated with said gas tank on the upstream side.

2. A refrigerant evaporator according to claim 1, wherein said gas and liquid separation means is provided with an enlarged portion in which the cross-sectional surface area of the refrigerant passageway is enlarged downward of an inlet passageway at said inlet passageway into which the refrigerant introduced from said pressure reduction means flows; and said enlarged portion is communicated with said liquid accumulation chamber.

3. A refrigerant evaporator according to claim 1, wherein said gas tank is provided with a throttle portion reducing the surface area of the passageway of said gas tank so that the amount of the gas refrigerant flowing from said gas tank into said gas refrigerant passageways of said refrigerant passageways becomes smaller on the downstream side than that on the upstream side inside said gas tank in the direction of flow of the refrigerant inside said gas tank.

4. A refrigerant evaporator according to claim 2, wherein said gas tank is provided with a throttle portion reducing the surface area of the passageway of said gas tank so that the amount of the gas refrigerant flowing from said gas tank into said gas refrigerant passageways of said refrigerant passageways becomes smaller on the downstream side than that on the upstream side inside said gas tank in the direction of flow of the refrigerant inside said gas tank.

5. A refrigerant evaporator comprising:

a plurality of refrigerant passageways arranged in parallel;

at least one fin which is interposed among said plurality of refrigerant passageways and forms a heat exchange portion together with said refrigerant passageways;

a gas and liquid separation means which is formed on a plate being disposed parallel to said plurality of refrigerant passageways so that said gas and liquid separation means is provided integrally with said refrigerant evaporator itself, and which separates a refrigerant of a two-phase gas and liquid state introduced from the pressure reduction means into a liquid refrigerant and a gas refrigerant;

a liquid refrigerant supply means which supplies only the liquid refrigerant, among the liquid refrigerant and gas refrigerant separated by said gas and liquid separation means, to said refrigerant passageways; and a gas refrigerant supply means which supplies only the gas refrigerant, among the liquid refrigerant and gas refrigerant separated by said gas and liquid separation means, to said refrigerant passageways.

6. A refrigerant evaporator comprising:

a plurality of refrigerant passageways arranged in parallel;

at least one fin which is interposed among said plurality of refrigerant passageways and forms a heat exchange portion together with said refrigerant passageways;

a gas and liquid separation means which is formed on a plate being disposed parallel to said plurality of refrigerant passageways so that said gas and liquid separation means is provided integrally with said refrigerant evaporator itself, and which separates a refrigerant of a two phase gas and liquid state introduced from the pressure reduction means into a liquid refrigerant and a gas refrigerant;

a liquid tank to which the liquid refrigerant separated by said gas and liquid separation means is introduced; and a gas tank to which the gas refrigerant separated by said gas and liquid separation means is introduced, said plurality of refrigerant passageways being communicated with said liquid tank and said gas tank.

7. A refrigerant evaporator comprising:

a plurality of refrigerant passageways arranged in parallel and having an upstream side;

at least one fin which is interposed among said plurality of refrigerant passageways and forms a heat exchange portion together with said refrigerant passageways;

a gas and liquid separation means which is formed on a plate being disposed parallel to said plurality of refrigerant passageways so that said gas and liquid separation means is provided integrally with said refrigerant evaporator itself, and which separates a refrigerant of a two-phase gas and liquid state introduced from the pressure reduction means into a liquid refrigerant and a gas refrigerant, and which is provided with a liquid accumulation chamber for accumulating the separated liquid refrigerant; and a liquid tank communicated with said liquid accumulation chamber, said plurality of refrigerant passageways being communicated with said liquid tanks on the upstream side.

8. A refrigerant evaporator comprising:

a plurality of refrigerant passageways arranged in parallel, each of said passageways having one end portion;

at least one fin which is interposed among said plurality of refrigerant passageways and forms a heat exchange portion together with said refrigerant passageways;

a plurality of tanks communicated to each said one end portion of said plurality of refrigerant passageways;

a gas and liquid separation means which is formed on a plate being disposed parallel to said plurality of refrigerant passageways so that said gas and liquid separation means is provided integrally with said refrigerant evaporator itself, and which separates a refrigerant of a two-phase gas and liquid state introduced from the pressure reduction means into a liquid refrigerant and a gas refrigerant;

a first passageway means which distributes the liquid refrigerant separated by said gas and liquid separation means and supplies the liquid refrigerant to said plurality of tanks; and a second passageway means which distributes the gas refrigerant separated by said gas and liquid separation means and supplies the gas refrigerant to said plurality of tanks.

* * * * *